US012007191B1

(12) United States Patent
Kellgren

(10) Patent No.: US 12,007,191 B1
(45) Date of Patent: Jun. 11, 2024

(54) SEMIAUTOMATIC HANDGUN

(71) Applicant: Kel-Tec CNC Industries Inc., Cocoa, FL (US)

(72) Inventor: George Kellgren, Cocoa, FL (US)

(73) Assignee: KEL-TEC CNC INDUSTRIES, INC., Cocoa, FL (US)

( * ) Notice: Subject to any disclaimer, the term of this patent is extended or adjusted under 35 U.S.C. 154(b) by 0 days.

(21) Appl. No.: 18/108,939

(22) Filed: Feb. 13, 2023

(51) Int. Cl.
*F41A 3/66* (2006.01)
*F41A 5/06* (2006.01)
*F41A 19/14* (2006.01)

(52) U.S. Cl.
CPC ..... *F41A 3/66* (2013.01); *F41A 5/06* (2013.01); *F41A 19/14* (2013.01)

(58) Field of Classification Search
CPC ..... F41A 5/04; F41A 5/06; F41A 19/14
USPC ..... 89/163, 162, 160, 171; 42/19, 69.03
See application file for complete search history.

(56) References Cited

U.S. PATENT DOCUMENTS 3,158,064 A * 11/1964 Charron ..... F41A 25/22 89/196
5,309,815 A * 5/1994 Moller ..... F41A 5/04 89/196
8,752,474 B2 * 6/2014 Vanek ..... F41A 5/06 89/198
10,018,433 B2 * 7/2018 Tuason ..... F41A 3/46

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A firearm is disclosed which is a handgun having a frame and a slide connected to the frame which is operable to reciprocate between a forward battery position and a rearward recoil position. The barrel is connected to the frame and to the slide and it has a forward muzzle end and a rearward chamber end that rotates between a locked position and an unlocked position during cycling of the firearm. The barrel has locking elements at its forward end including a plurality of protruding lugs configured to interface with the slide in the locked position when the slide is in the battery position to prevent axial movement of the slide with respect to the barrel. Moving the trigger forward out of its released position lowers a barrel locking component out of engagement with a slidable trunnion to allow the slide and barrel to disassemble from the frame.

19 Claims, 18 Drawing Sheets

A – A

DETAIL D1

DETAIL D2

A–A

A–A

A–A

B – B

C – C

E – E

SEMIAUTOMATIC HANDGUN

FIELD OF THE INVENTION

The present invention relates to semiautomatic handguns.

BACKGROUND AND SUMMARY

Over the development history of semiautomatic handguns, also called autoloaders, users have continually demanded improvements in safety and reliability without sacrificing robustness for withstanding environmental extremes and resisting combat damage. New features and mechanisms reduced the chances of accidental discharges when a loaded weapon is dropped, and other inventions sought to disable a weapon from firing unless a proper grip strength was detected. In other developments, the first effective mechanisms for cycling a weapon: loading ammunition, locking the breech for firing, expelling a spent cartridge and reloading the next round of ammunition, were initially complex and included subassemblies with large numbers of interoperating components and features.

Additional complexity accrued while developing effective fire control systems that could reliably protect from accidental discharge in a "safe" position but also differentiate between semiautomatic and fully automatic fire by halting the repeating fire unless a trigger reset by the user has been mechanical detected.

In any case, since propellant gas residue diffuses within the internal cavities of the weapon during use, and these residues or their byproducts are often caustic or corrosive, the user is left with a maintenance chore of disassembling and cleaning as many components and interstices as may be accessed while avoiding disassembly of critical components which require exacting skill or calibration to restore. Over the past 100 years of development or more, even while reliability and performance improved, disassembly and cleaning of a semiautomatic pistol was simplified from handling over two dozen separate parts for certain World War One era designs down to a handful of seven or fewer parts for devices currently in service. There are continuing demands to develop and produce highly reliable and safe mechanisms which are easy to disassemble and clean, have a reasonably manageable number of parts or integrated subassemblies, and which exclude re-assembly or use in any configuration except the best mode assembly.

The above disadvantages are addressed by a firearm which is a handgun having a frame and a slide connected to the frame which is operable to reciprocate between a forward battery position and a rearward recoil position. The barrel is connected to the frame and to the slide and it has a forward muzzle end and a rearward chamber end that rotates between a locked position and an unlocked position during cycling of the firearm. The barrel has locking elements at its forward end including a plurality of protruding lugs configured to interface with the slide in the locked position when the slide is in the battery position to prevent axial movement of the slide with respect to the barrel. Moving the trigger forward out of its released position lowers a barrel locking component out of engagement with a slidable trunnion to allow the slide and barrel to disassemble from the frame. The disclosed design also includes distinctive and appealing ornamentalities.

DETAILED DESCRIPTION OF A PREFERRED EMBODIMENT

The invention is a firearm which is a semiautomatic handgun having numerous improvements and inventive mechanisms. A rotary interlock couples axial motion of the barrel with the retraction of the slide assembly and its return to battery during certain portions of the discharge and reloading cycle. Another interlocking mechanism traps the slide assembly to the frame for longitudinal travel except when a forward displacement of the trigger allows disassembly for inspection, cleaning, and maintenance. The recoil spring for the slide is an especially compact subassembly of helical springs acting in concert. The rotary hammer is driven by a spring which combines axial extension of helical portions with cantilever bending of another portion of the spring. The handgun has a magazine well with a detachable bottom cap rather than a detachable magazine. The firearm also offers distinctive and appealing ornamentalities including a ribbed slide assembly which provides positive grip for grabbing and racking the slide assembly.

Figure 1A:
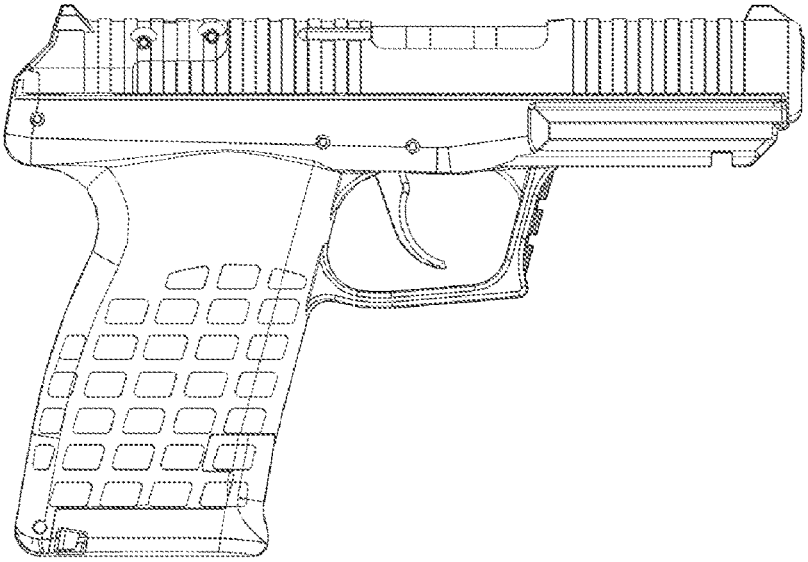
FIG. 1*a* shows a right side elevation view of an embodiment of a semiautomatic handgun in accordance with the invention.
Figure 1B:
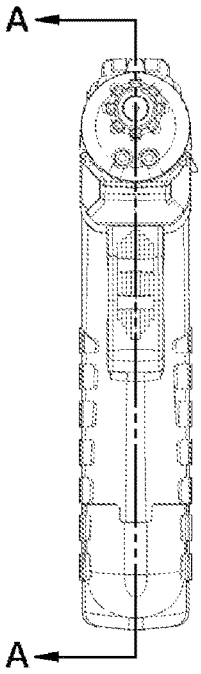
FIG. 1*b* shows a front elevation view of the semiautomatic handgun of FIG. 1*a* and defining section line A-A for the cross section views of FIGS. 4, 15*a*, 15*b*, and 15*c*.
Figure 1C:
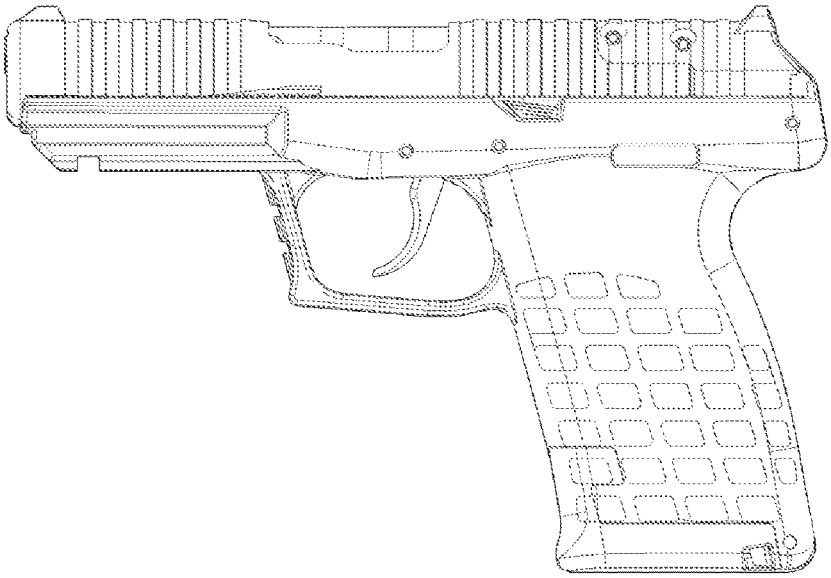
FIG. 1*c* shows a left side elevation view of the semiautomatic handgun of FIG. 1*a*.
Figure 1D:
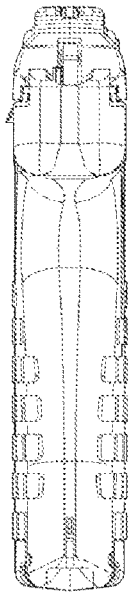
FIG. 1*d* shows a rear elevation view of the semiautomatic handgun of FIG. 1*a*.
Figure 1E:
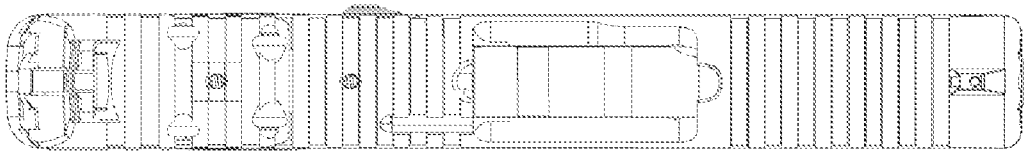
FIG. 1*e* shows a top view of the semiautomatic handgun of FIG. 1*a*.
Figure 1F:
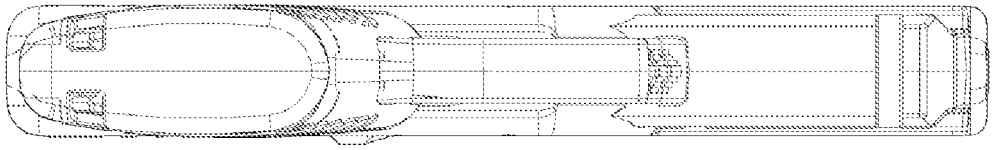
FIG. 1*f* shows a bottom view of the semiautomatic handgun of FIG. 1*a*.
Figure 2A:
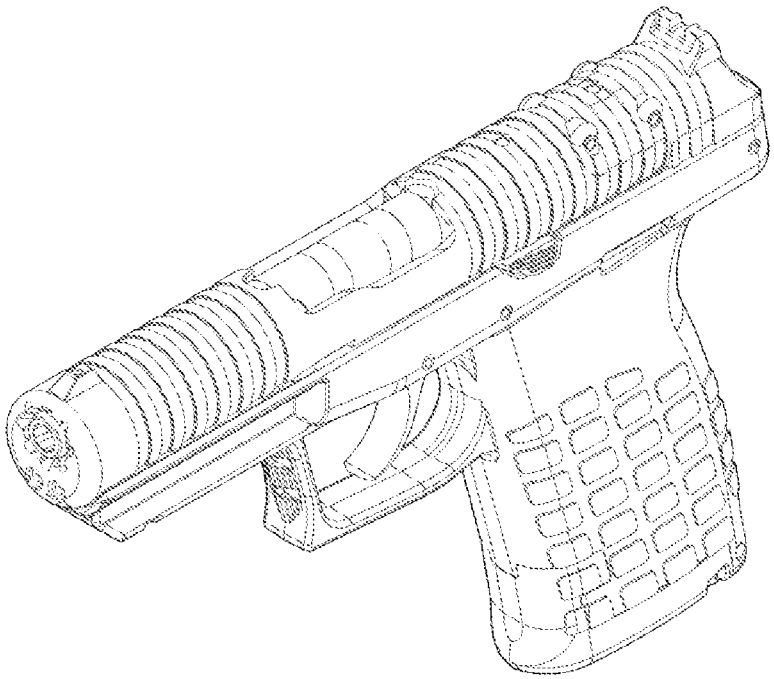
FIG. 2*a* shows an oblique, front left top view of the semiautomatic handgun of FIG. 1*a*.
Figure 2B:
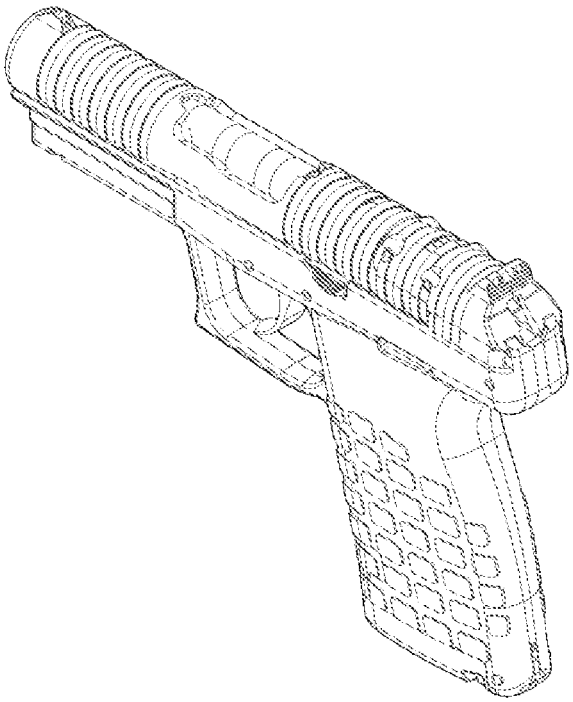
FIG. 2*b* shows an oblique, rear left top view of the semiautomatic handgun of FIG. 1*a*.
Figure 2C:
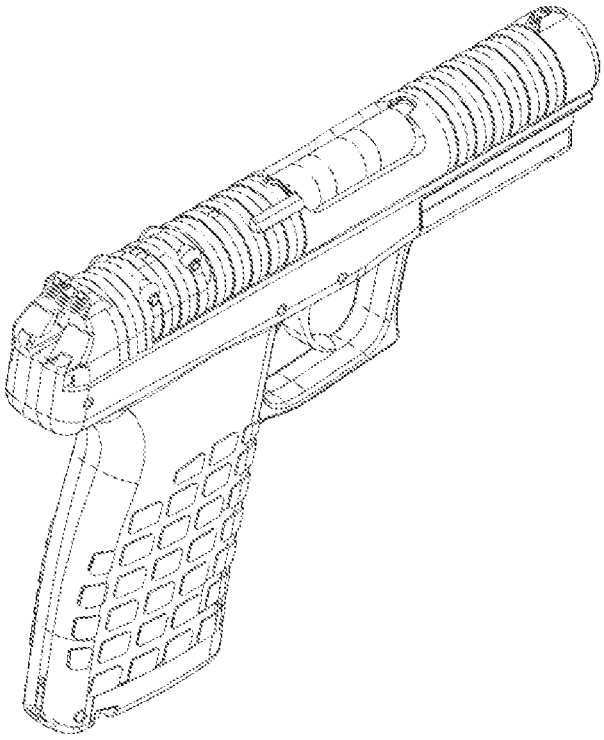
FIG. 2*c* shows an oblique, rear right top view of the semiautomatic handgun of FIG. 1*a*.
Figure 2D:
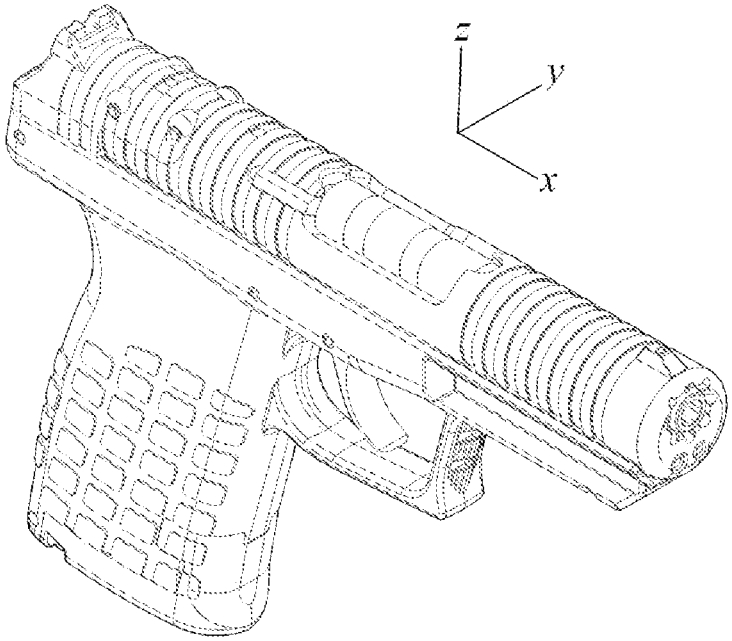
FIG. 2*d* shows an oblique, front right top view of the semiautomatic handgun of FIG. 1*a*.
Figure 3A:
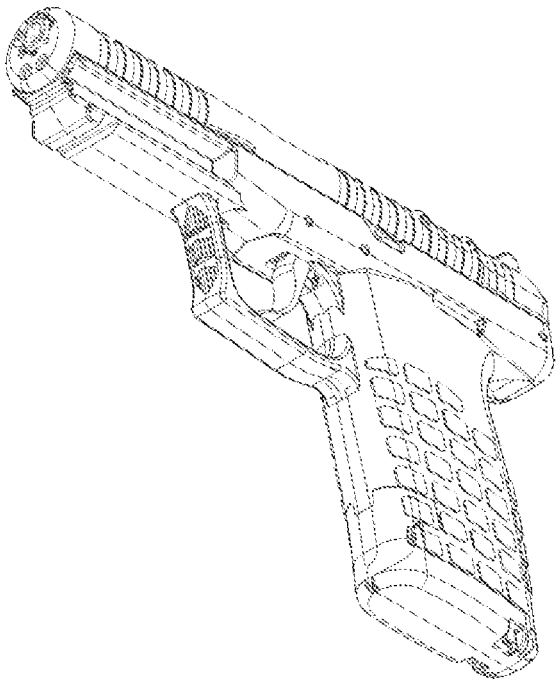
FIG. 3*a* shows an oblique, front left bottom view of the semiautomatic handgun of FIG. 1*a*.
Figure 3B:
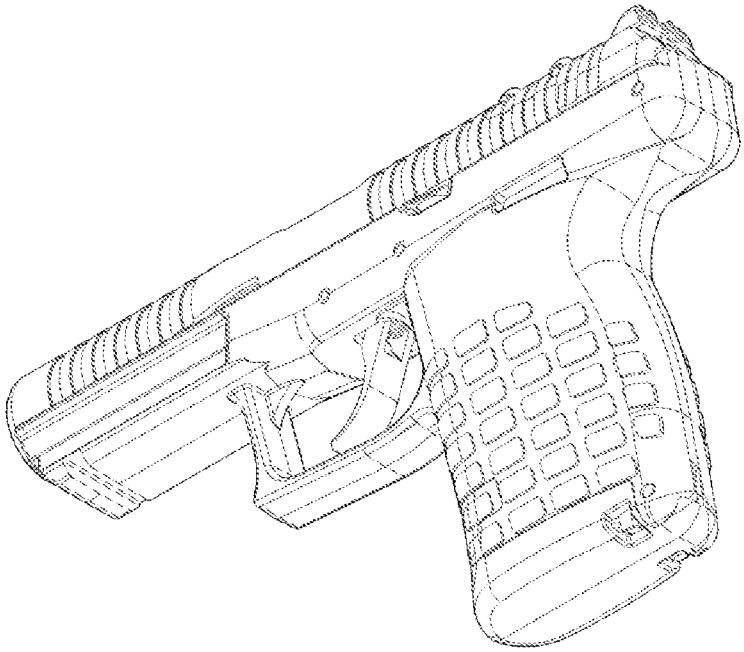
FIG. 3*b* shows an oblique, rear left bottom view of the semiautomatic handgun of FIG. 1*a*.
Figure 3C:
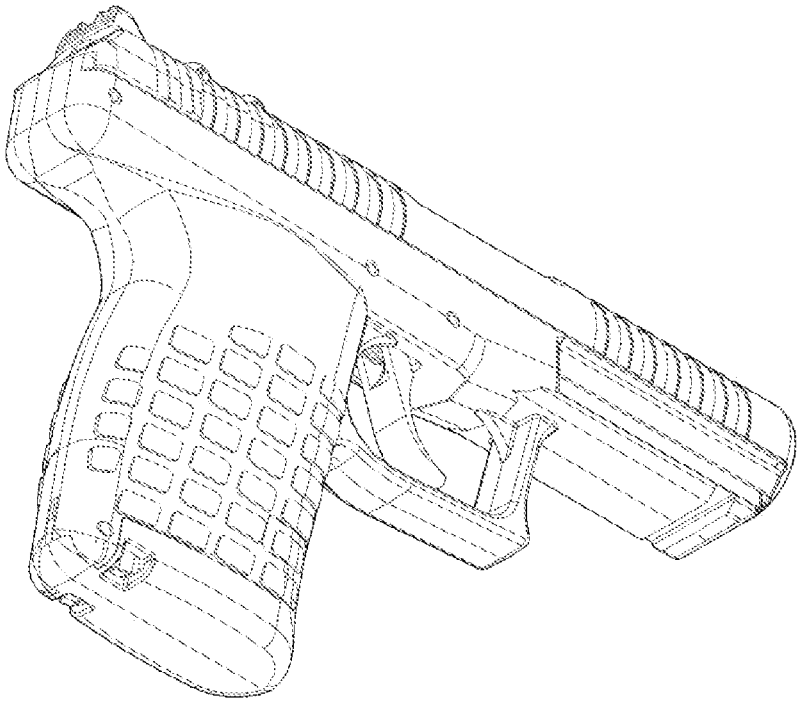
FIG. 3*c* shows an oblique, rear right bottom view of the semiautomatic handgun of FIG. 1*a*.
Figure 3D:
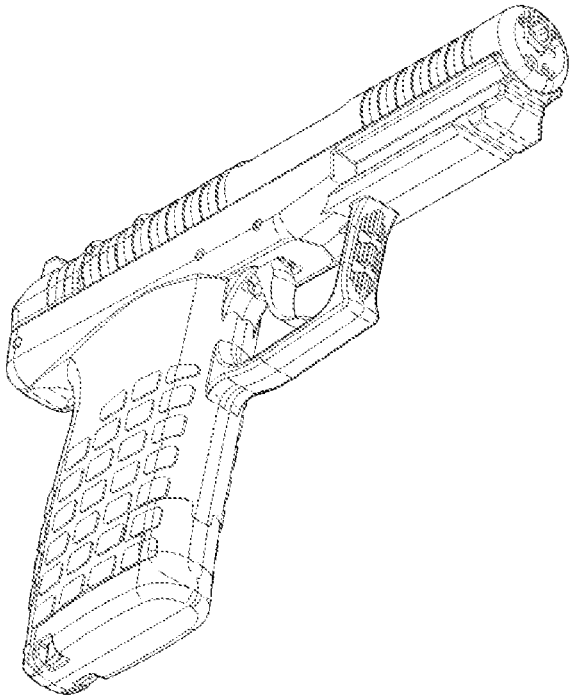
FIG. 3*d* shows an oblique, front right bottom view of the semiautomatic handgun of FIG. 1*a*.

Referring now to the figures, FIG. 1*a* through if, 2*a* through 2*d*, and 3*a* through 3*d* present orthogonal and oblique views of the ornamentalities of the firearm. FIG. 1*b* defines section line A-A for the cross section views of FIGS. 4, 15*a*, 15*b*, and 15*c*. FIG. 2*d* includes a reference coordinate system for defining common terms for orientations, motions, and view aspects of the figures and components.

In this specification, direction indicating words such as "forward" mean a first direction parallel to the shooting direction and the barrel axis of the weapon and in the direction of the bullet motion during discharge, and "rearward" is a direction parallel to "forward" but opposite to the bullet motion during discharge. "Forward" and "rearward" directions are also "longitudinal" directions, and words such as "ahead" and "behind" shall be taken to mean an ordering of components proceeding along and parallel to a horizontal direction proceeding from the muzzle end of the barrel to the chamber end of the barrel. A forward or longitudinal direction correlates to the "x" axis of FIG. $2d_1$.

A "sagittal plane" is a midplane which contains both the barrel axis and the central axis of the ammunition well. A "transverse" direction is a direction parallel to a transverse axis residing at the intersection of the sagittal plane and a plane perpendicular to the barrel axis. A transverse direction correlates to the "y" axis of FIG. $2d_1$.

A "vertical" direction is a direction along an axis perpendicular to both the barrel axis and a transverse axis intersecting the barrel axis. For components in the vicinity of the slide assembly, the words "up," "upward, "above," "top" and their complementary opposites "down," "downward," "beneath," "below," and "underside" shall be taken to indicate vertical motion, direction, orientation, or an ordering of components proceeding along a vertical direction. An upward direction correlates to the "z" axis of FIG. 2$d_1$.

In descriptions of the barrel slide assembly and the intermating slide receiving surfaces of the frame, the word "axial" shall pertain to a direction or axis parallel to the barrel axis and the excursion direction of the slide assembly during recoil and during its return to an in-battery condition. However, in descriptions of the components and features related to the grip portion of the weapon, such as but not limited to the ammunition well, the words "axis" and "axial" shall pertain to a direction parallel to the central axis of the ammunition well inside the grip and the feed direction of the follower while cartridges are being removed or expended from the ammunition well. Also, in this specification the word "by" includes locative meanings such as "next to" or "proximate to" the entity to which it refers.

Figure 4:
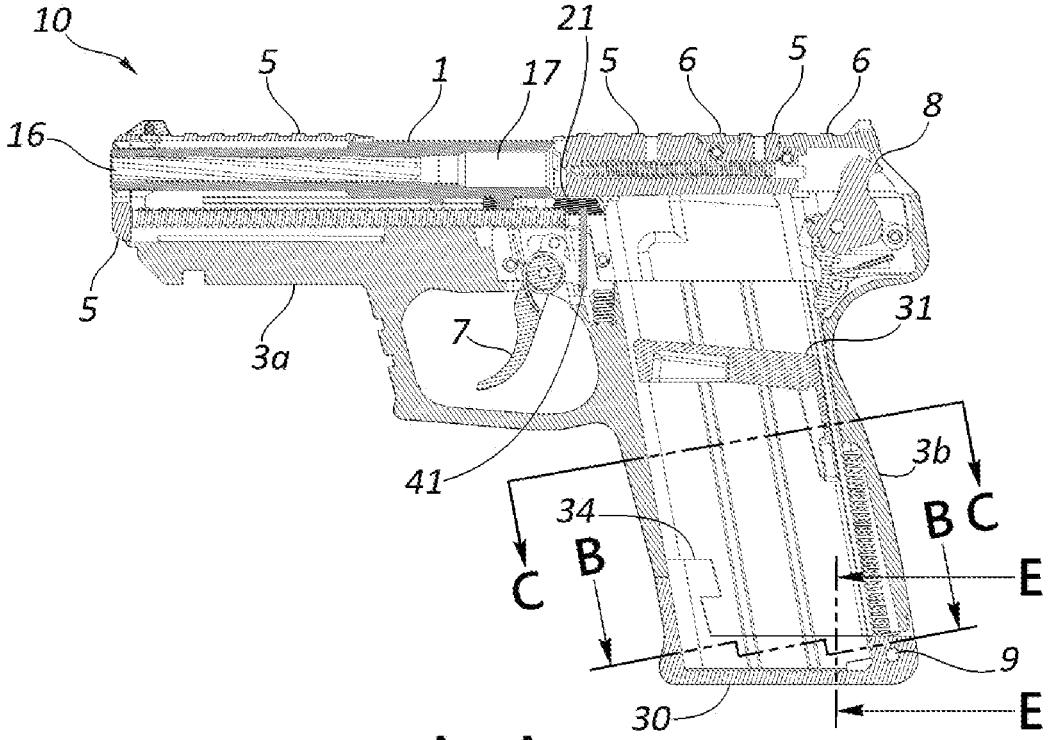
FIG. 4 shows a cross section view of the semiautomatic handgun of FIG. 1*a* taken at section line A-A defined in FIG. 1*b*, and defining offset section line B-B for the cross section view of FIG. 16*c*, section line C-C for the cross section views of FIG. 16*d* and FIG. 17, and section line E-E for the cross section view of FIG. 20.
Figure 16A:
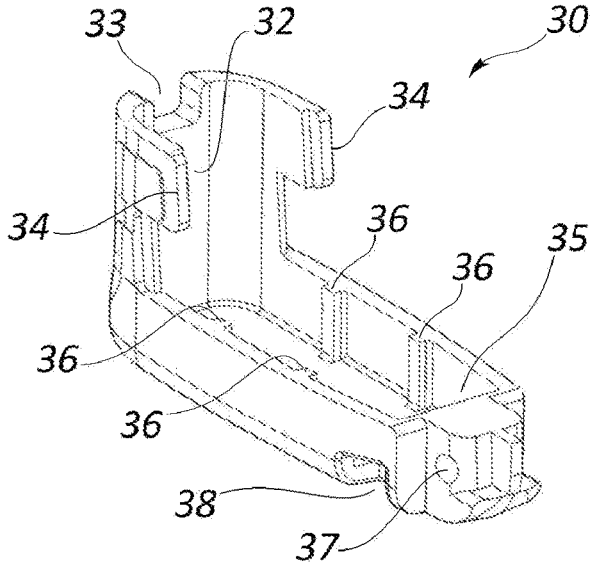
FIG. 16*a* shows an oblique, rear top left view of a grip bottom or magazine well bottom cap for a semiautomatic handgun in accordance with the invention.
Figure 16B:
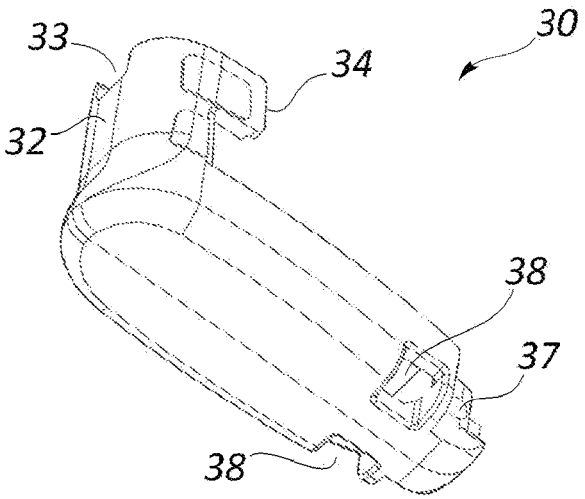
FIG. 16*b* shows an oblique, front bottom left view of a grip bottom or magazine well bottom cap for a semiautomatic handgun in accordance with the invention.
Figure 16C:
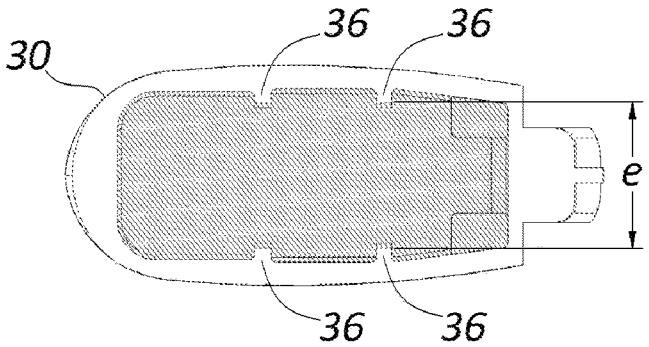
FIG. 16*c* shows a cross section view of the grip bottom of FIG. 16*a* taken at the offset section line B-B of FIG. 4, and in which the cross hatching of the section is applied to the void space defining the magazine well.
Figure 16D:
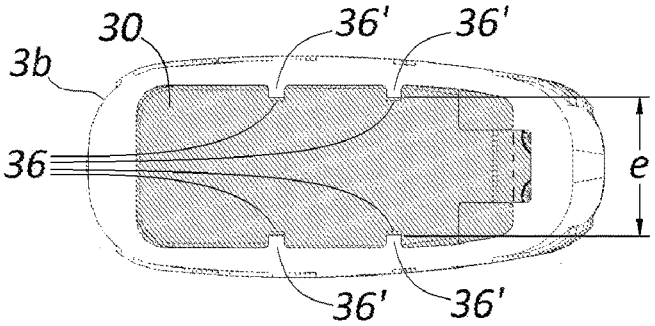
FIG. 16*d* shows a cross section view of the lower portion of the grip and bottom cap of the semiautomatic handgun of FIG. 1*a* taken at section line C-C of FIG. 4.
Figure 17:
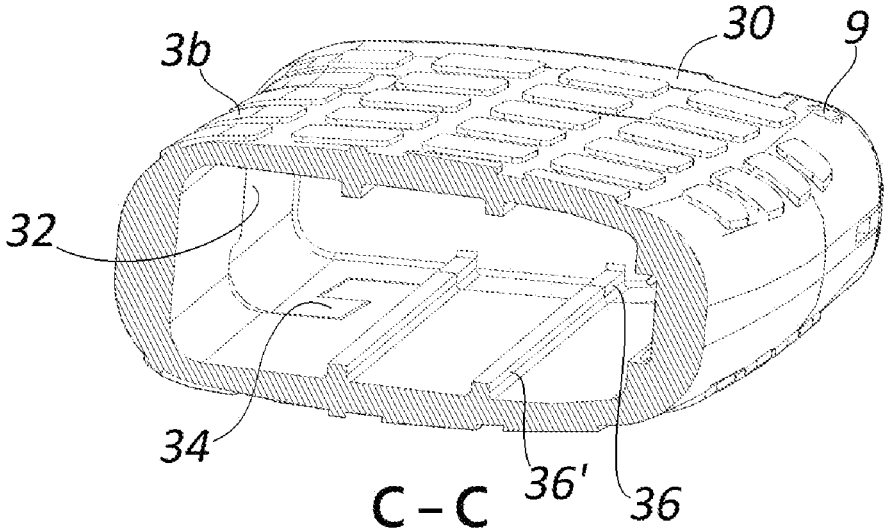
FIG. 17 shows the cut section of the lower portion of the grip and the bottom cap of the semiautomatic handgun of FIG. 16*d* rotated to an oblique, rear top right view.
Figure 20:
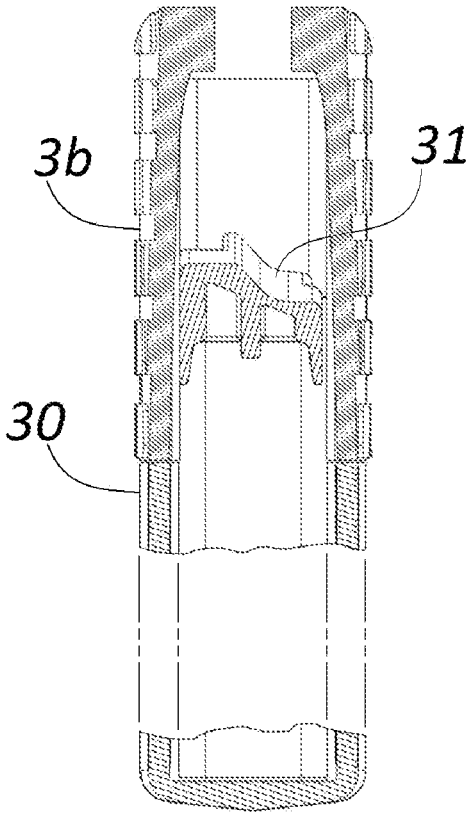
FIG. 20 shows a cross section view of the lower portion of the grip and the bottom cap of the semiautomatic handgun of FIG. 1*a* taken at section line E-E of FIG. 4, and also showing the bottom cap as broken portions to illustrate an alternative embodiment for extending the ammunition capacity of the magazine well.

FIG. 4 shows a cross section view of the semiautomatic handgun [10] of FIG. 1*a* taken at section line A-A defined in FIG. 1*b*, and defining offset section line B-B for the cross section view of FIG. 16*c*, section line C-C for the cross section views of FIG. 16*d* and FIG. 17, and section line E-E for the cross section view of FIG. 20.

The firearm comprises a grip body and a slide [5] connected to the frame and operable to reciprocate between a forward battery position shown and a rearward recoil position. The grip body includes a frame support portion [3*a*] and a hand-held portion [3*b*.] The slide is pinned to a slide cover [6] which also shrouds the hammer [8.] The cutting plane of this view passes through interleaving and interlocking sections of the slide and slide cover and so the index numerals for these parts are shown in more than one place. The firearm barrel [1] connected to the frame and to the slide, and the barrel has a forward muzzle end [16] and a rearward chamber end [17.] The trigger [7] includes a mechanism having a vertical yoke [41] for locking the trunnion plate [21] into place which in turn traps the slide assembly and barrel to the frame. The firearm stores ammunition rounds in a magazine well rather than a detachable magazine. An ammunition follower [31] travels within the well cavity which is defined in part by a bottom cap [30] which also includes at its forward portion a tongue extending upward and a pair of arms [34] or tabs at the top of the tongue that extend rearward and longitudinally. The bottom cap is secured by its arms being received within notches at the front of the lower grip body and a transverse pin [9] transfixing the lower rear corner of the grip body and the rear of the bottom cap. The follower spring is omitted from this view.

Figure 5:
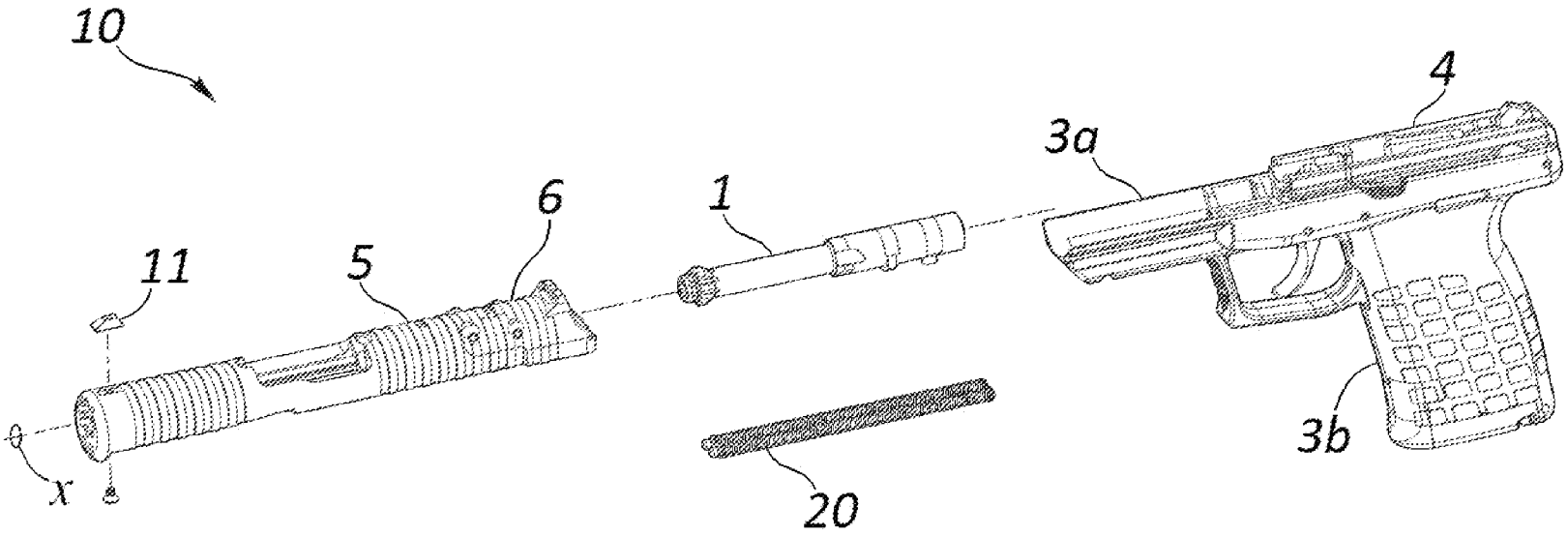
FIG. 5 shows an oblique, front left top view of the semiautomatic handgun of FIG. 1*a* with some components and subassemblies exploded away from the frame and grip portions of the firearm.

FIG. 5 shows an oblique, front left top view of the semiautomatic handgun [10] of FIG. 1*a* with some components and subassemblies exploded away from the frame and grip portions of the firearm. The slide [5] is part of a composite assembly which includes a rear component which is a slide cover [6] pinned to the slide. The slide and slide cover have complementary interdigitating features. The slide assembly includes distinctive ribbing which provides positively grippable surfaces to aid in racking the slide. The front sight [11] is affixed to the top front of the slide by internally contained hardware such as a threaded fastener. The gun barrel [1] is contained within the slide assembly and is captured by a trunnion plate that is axially and transversely secured within the frame [4] near the upper portion [3*a*] of the grip body. The lower portion or hand held portion [3*b*] of the grip body extends downward from the frame slide rails and the hammer mechanism and the fire control components associated with the hammer and the trigger. The frame component drops into the grip body and may be affixed to it substantially permanently by transverse pins or other fasteners. The frame component is the part that is serialized and to which the slide connects and moves relative to the rest of the pistol. The slide assembly recoils rearward during discharge and is returned to battery for the next round by a recoil spring assembly [20.] In preferable embodiments the grip body may be made of a polymer or composite material and the frame and slide components may be made of metal such as steel.

Figure 6A:
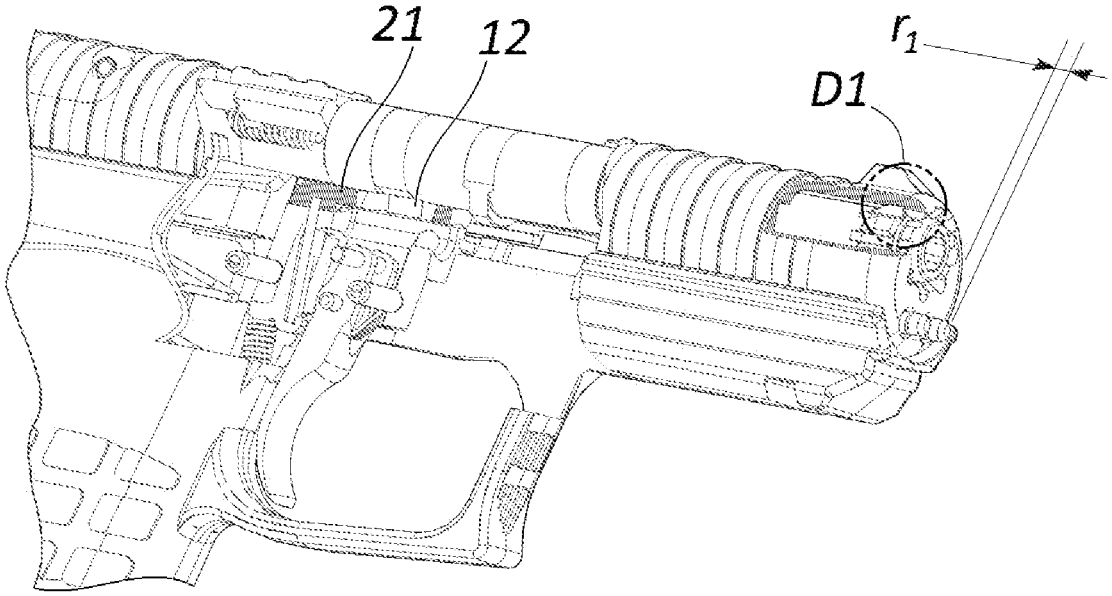
FIG. 6*a* shows a partial oblique front right bottom view of the semiautomatic handgun of FIG. 1 with cutaways in the slide and frame components to reveal interlocking functions of the slide, barrel, and trunnion while the slide is at a first partially recoiled position, and defines detail portion D1 for the detail view of FIG. 7*a*.
Figure 7A:
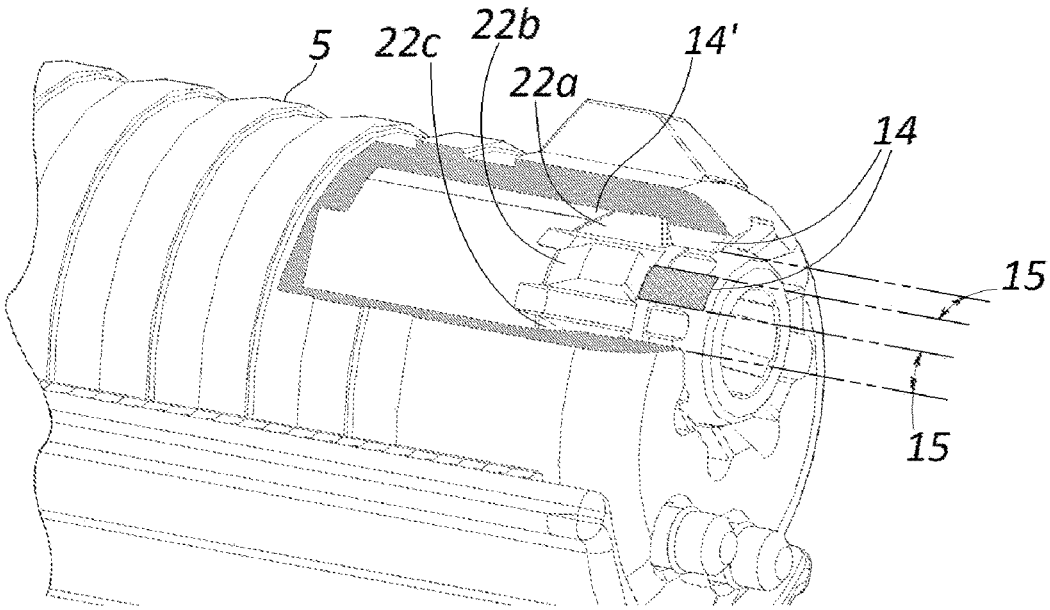
FIG. 7*a* shows detail view D1 as defined in the oblique view FIG. 6*a*.

FIG. 6*a* shows a partial oblique front right bottom view of the semiautomatic handgun of FIG. 1 with cutaways in the slide and frame components to reveal interlocking functions of the slide, barrel, and trunnion [21] while the slide is at a first partially recoiled position, and defines detail portion [D1] for the detail view of FIG. 7*a*. In this view the slide and barrel have recoiled rearwardly by a first partial recoil distance [$r_1$.] The barrel is operable to rotate between a locked position and an unlocked position and the barrel includes one or more locking elements proximate the forward end which will be more fully described in FIGS. 7*a*, 7*b*, 8*a*, and 8*b*. The rotating barrel has a radial array of locking lugs which seat into a complementary radial array of internal notches at muzzle end of slide. The trunnion includes a zigzag slot with a first dwell section residing in its midplane and a second dwell section longitudinally displaced along an axis and also angularly and transversely displaced. The barrel includes a downwardly protruding tang [12.] In the assembly, when the pistol is in a battery condition the tang of the barrel protrudes downward and is received within the trunnion slot.

With the barrel tang in its first dwell position within the trunnion slot, the lugs at its muzzle end are engaged with complementary radial array of notches in the slide, so that longitudinal excursion of the barrel with respect to the slide is prevented.

Figure 6B:
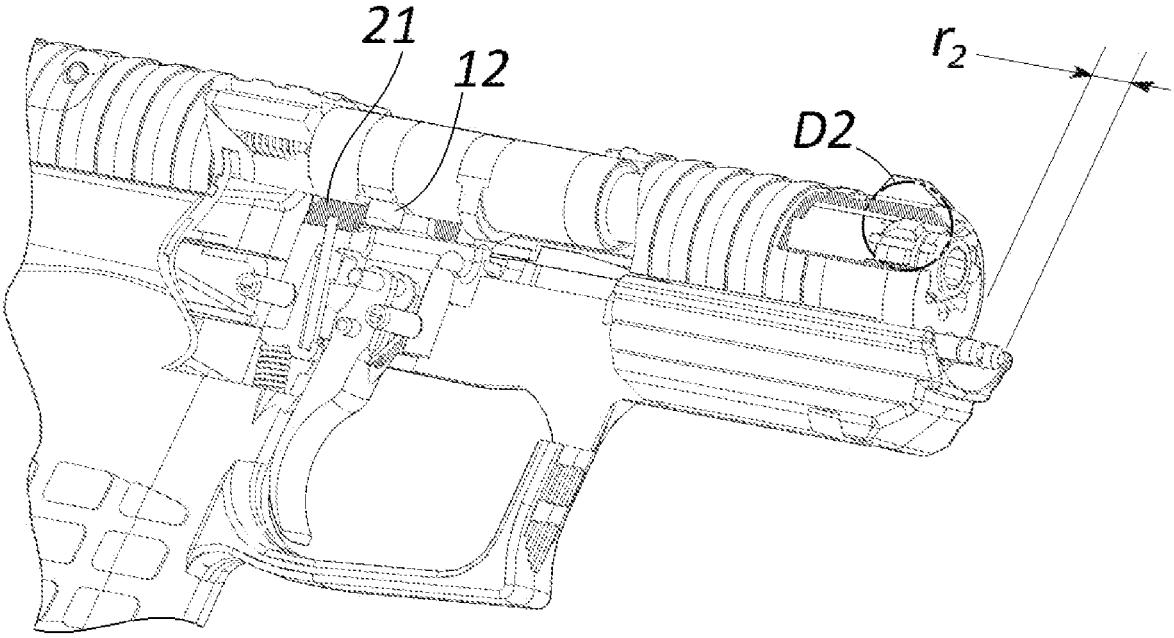
FIG. 6*b* shows a partial oblique front right bottom view of the semiautomatic handgun of FIG. 1 with cutaways in the slide and frame components to reveal interlocking functions of the slide, barrel, and trunnion while the slide is at a second partially recoiled position, and defines detail portion D2 for the detail view of FIG. $7b_2$.
Figure 7B:
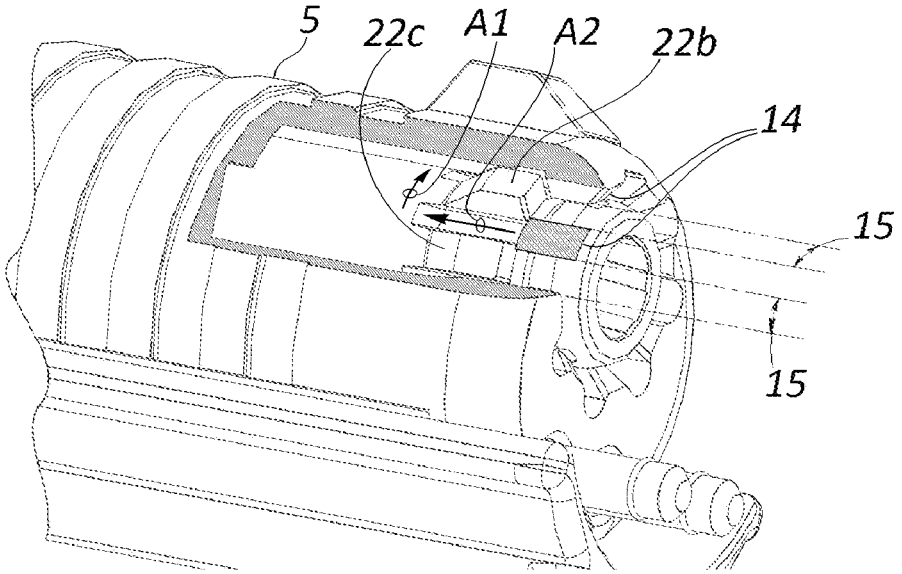
FIG. 7*b* shows detail view D2 as defined in the oblique view FIG. $6b_2$.

FIG. 6*b* shows a partial oblique front right bottom view of the semiautomatic handgun of FIG. 1 with cutaways in the slide and frame components to reveal interlocking functions of the slide, barrel, and trunnion while the slide is at a second partially recoiled position, and defines detail portion [D2] for the detail view of FIG. 7*b*. In this view the slide and barrel have recoiled rearwardly by a second partial recoil distance [$r_2$.] As will be seen in FIG. 7*b*, the locking elements are configured to interface with the slide in the locked position when the slide is in or still close to the battery position to prevent axial movement of the slide with respect to the barrel. During these initial recoil portions, the barrel and slide travel axially in unison and the underside tang [12] of the barrel still resides within the portion of the zigzag slot of the trunnion [21] which is centered in the sagittal plane of the firearm.

The forward rim of the muzzle is embraced within a radially notched aperture in the forward end face of the slide. Only when the trunnion is removed from the slide assembly may the barrel and its tang be rotated so that barrel lugs near the muzzle end fully clear the notched interior fins of the slide, and then the barrel may be moved rearward so that the rim of the muzzle clears the notched aperture of the forward end face of the slide. Once thusly cleared, the barrel may be disassembled from the rest of the slide assembly. The barrel rotates because the tang first now encounters a first transitional surface which includes a first twist angle so that the barrel rotates by an angular displacement sufficient to dislodge its locking lugs from the lock notches in the forward portion of the slide.

Figure 6C:
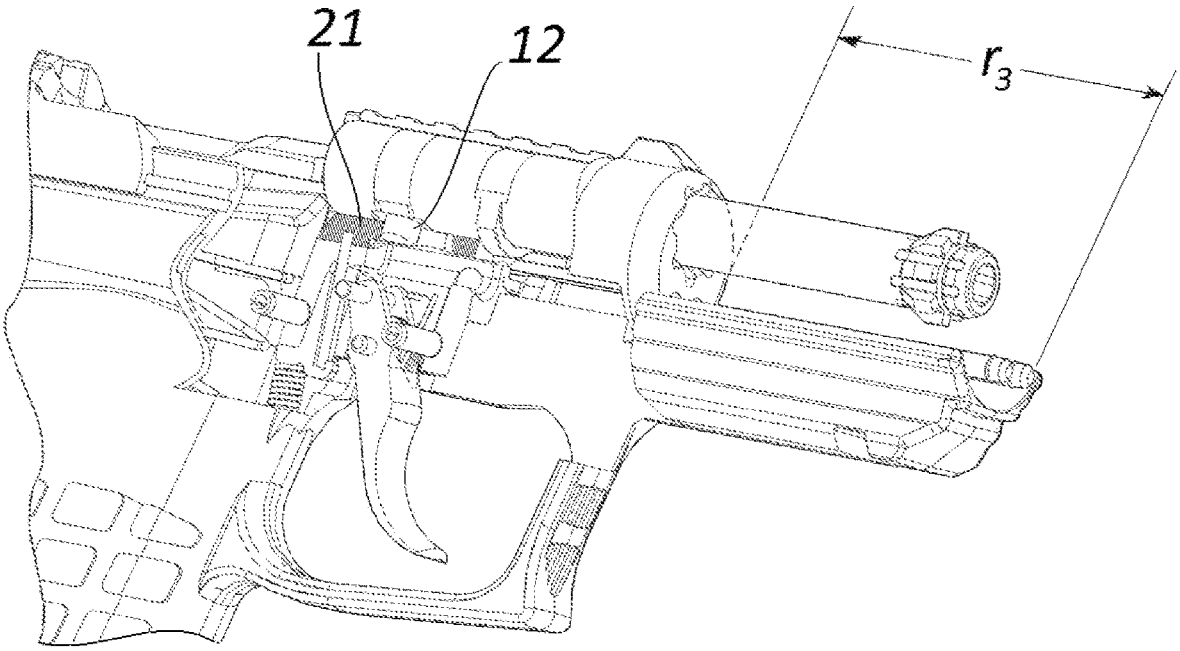
FIG. 6*c* shows a partial oblique front right bottom view of the semiautomatic handgun of FIG. 1 with cutaways in the slide and frame components to reveal interlocking functions of the slide, barrel, and trunnion while the slide is at a fully recoiled position wherein the slide locks back with the magazine well open and the trigger released.

FIG. 6*c* shows a partial oblique front right bottom view of the semiautomatic handgun of FIG. 1 with cutaways in the slide and frame components to reveal interlocking functions of the slide, barrel, and trunnion while the slide is at a fully recoiled position wherein the slide locks back with the magazine well open and the trigger released. In this view the slide and barrel have recoiled rearwardly by a fully recoiled recoil distance [$r_3$] to a rearward recoil position. At this portion of the recoil and reload cycle, the underside tang [12] of the barrel now resides within the portion of the zigzag slot of the trunnion [21] which is radially and transversely offset from the sagittal plane of the firearm, which causes the barrel to rotate axially so that the locking elements of the barrel disengage from complementary locking elements internal to the aperture in the forward end face of the slide. In this condition the locking element is configured to enable relative movement of the slide with respect to the barrel when the barrel is in the unlocked position.

Advantageously as compared to certain earlier semiautomatic handguns, although the barrel rotates, the axis of the barrel remains parallel to the longitudinal axes of the slide assembly and of the frame. In earlier handgun designs the barrel is allowed to rotate about a transverse axis and elevates slightly when locked back in an open condition. The limits of precision of mechanical tolerances of these moving parts allow that when the barrel returns to battery it does not necessarily return to the exact axis as it was in the previous shot. In the design of the inventive firearm disclosed herein, the barrel axis rotates while remaining closely constrained to its original axis by journal bearing surfaces of the slide, the trunnion, and the frame.

The axial tolerances of these interoperating mechanical parts better preserve the relationship of the barrel axis to the frame, and ultimately, the impact point of a bullet fired from the weapon to the user's sight alignment or proprioception of the weapon's grip within the user's hands, so that this improved weapon may simply "feel" more accurate from one shot to the next.

FIG. 7*a* shows detail view [D1] as defined in the oblique view FIG. 6*a*. During this portion of the recoil phase, the radial array of lugs [22*a*, 22*b*, 22*c*] near the muzzle end of the barrel remain axially constrained within notch features of a complementary radial array of splines defined between the radial array of notches in the aperture of the front end face of the slide [5.] The slide defines at least one locking feature configured to receive the locking element of the barrel. In this case, each notched spline defines a block [14] axially forward of each barrel lug and another block [14'] axially aft of the lug.

While these two complementary sets of features remain interlocked, and while the recoil of the firearm drives the barrel rearward, the slide translates rearwardly in concert with the barrel. Much like the merlons and crenels of a battlement are complementary features of material and absence of material, the notches in the aperture of the front end face of the slide define axial "lugways" [15] which are absences of material wherein the lugs allow axial motion of the slide separate from axial motion or lack of motion of the barrel, but only when the barrel lugs are radially disengaged from the internal splines of the slide. At this portion of the recoil phase illustrated, the barrel continues to move rearward with respect to the trunnion from the first dwell position to the second dwell position axially displaced from the in-battery condition. With the barrel tang in its second dwell position within the trunnion slot, the lugs at its muzzle are angularly displaced but still remain partially engaged with the radial array of notches in the slide, so that longitudinal excursion of the barrel with respect to the slide is still prevented.

FIG. 7*b* shows detail view [D2] defined in the oblique view FIG. 6*b*. During this portion of the recoil phase, the barrel continues to move rearward with respect to the trunnion from the first dwell position to the second dwell position axially displaced from the in-battery condition. With the barrel tang in its second dwell position within the trunnion slot, the lugs at its muzzle are angularly displaced as shown by arrow [A1] and become disengaged from the radial array of notches in the slide, so that longitudinal excursion of the barrel with respect to the slide as shown by arrow [A2] now becomes possible. The barrel rotates because the tang first encounters a first transitional surface which includes a first twist angle so that the barrel rotates by an angular displacement sufficient to dislodge its locking lugs from the lock notches in the forward portion of the slide.

This rotation of the barrel causes lug [22*a*] seen in FIG. 7*a* to disappear under the cutaway edge by the front sight on the slid [5.] Lug [22*b*] rotates out from behind a blocking element [14] of an internal spline in the slide, and lug [22*c*] also rotates out from behind its blocking element. In this condition all the lugs on the barrel are now aligned with lugways [15] and the slide may now continue rearward excursion separate from any axial motion of the barrel.

Figure 8A:
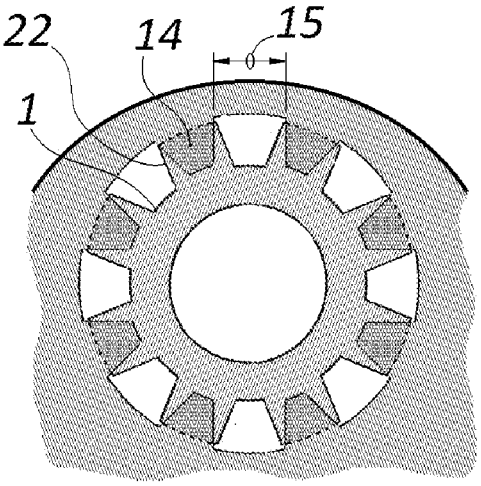
FIG. 8*a* shows a stylized front view of the interlocking components of the slide and barrel in a locked condition.

FIG. 8*a* shows a stylized front view of the interlocking components of the slide and barrel [1] in a locked condition. The locking element includes a plurality of protruding lugs [22] which are each axially trapped by spline portions [14] of the slide fore and aft of each lug. The axial notches in the front end aperture of the slide define lugways, and the slide has a forward portion defining a barrel aperture, and the lugways surround the aperture, but in this condition the lugs are not aligned with their lugways, and the barrel and slide move in concert in this condition.

Figure 8B:
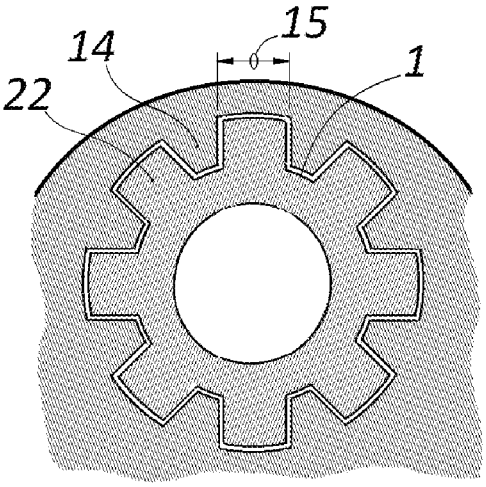
FIG. 8*b* shows a stylized front view of the interlocking components of the slide and barrel in a free condition.

FIG. 8*b* shows a stylized front view of the interlocking components of the slide and barrel in a free condition with the barrel [1] and its plurality of lugs [22] rotated clear of the slide splines and their blocking elements [14,] and rotated into alignment with their respective lugways [15.] In this embodiment shown the plurality includes at least 8 lugs, however it is possible to manufacture the inventive interlocking features having any other number of lugs, splines, and lugways, including a design having a single barrel end lug and a single complementary receiving pocket in the slide adjacent to a single lugway or axial groove communicating with the front end aperture of the slide.

Figure 9:
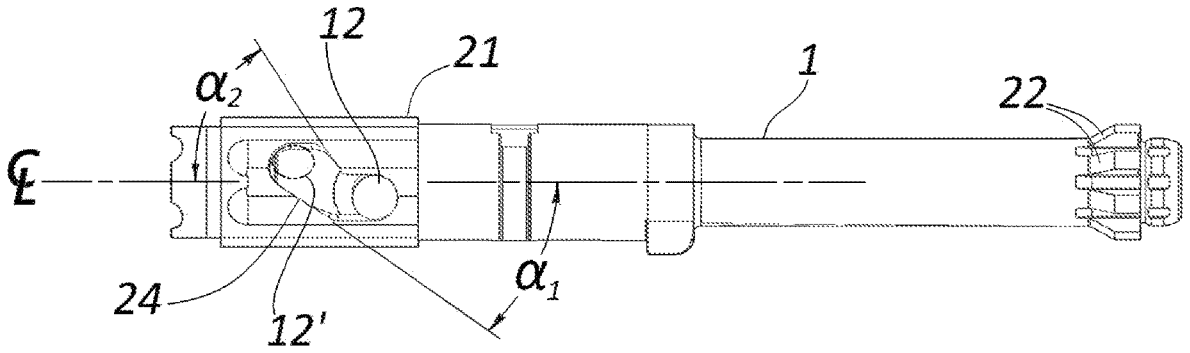
FIG. 9 shows a bottom view of the trunnion and barrel and the interoperation of a downwardly projecting tang of the barrel and its excursions within a zigzag slot feature of the trunnion.

FIG. 9 shows a bottom view of the trunnion [21] and barrel [1] and the interoperation of a downwardly projecting tang [12] of the barrel and its excursions within a zigzag slot feature of the trunnion. The zigzag slot [24] defines a cam path having a first dwell section residing in its midplane and a second dwell section longitudinally displaced along an axis and also angularly displaced. When the barrel moves rearward with respect to the trunnion the tang first slides directly rearward in the slot over a first length and then encounters a first transitional surface, which may be a helical surface or an approximation thereof, which includes a first twist angle [$\alpha_1$] so that the barrel rotates by an angular displacement sufficient to dislodge its locking lugs [22] from the lock notches in the forward portion of the slide. Further rearward motion guides the tang into the second dwell section of the trunnion slot. The tang is illustrated in phantom line [12'] in this second dwell section.

When the barrel is moved forward with respect to the trunnion from this condition toward the in-battery condition, the tang encounters and is guided by a second transitional surface, which may also be a helical surface or an approximation thereof, which includes a second twist angle [$\alpha_2$] The angular displacement per unit of linear motion of the tang while following in contact with this second transitional surface is greater than the angular displacement per unit of linear motion of the tang while following in contact with the first transitional surface. During a complete recoil and reloading cycle, if the barrel moves rearward with respect to the trunnion from the first dwell position to the second dwell position at a given axial velocity and then moves forward with respect to the trunnion from the second dwell position to the first dwell position at the same axial velocity, then during its forward movement the barrel would rotate faster than during its rearward movement.

Figure 10A:
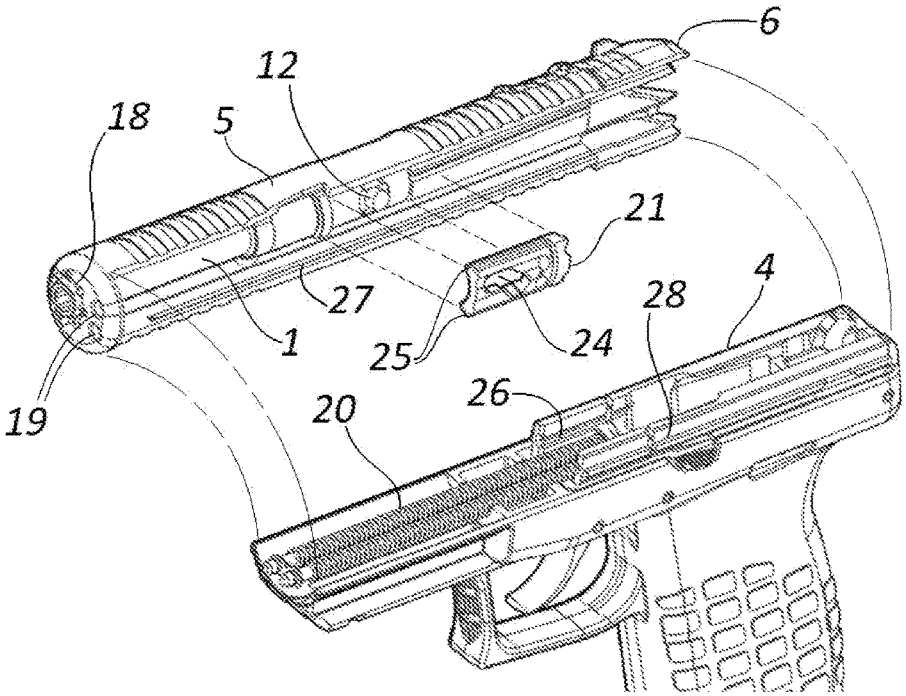
FIG. 10*a* shows an oblique, front left top view of the semiautomatic handgun of FIG. 1*a* with the slide assembly removed and the trunnion extracted from the slide assembly.

FIG. 10*a* shows an oblique, front left top view of the semiautomatic handgun of FIG. 1*a* with the slide assembly removed and the trunnion extracted from the slide assembly. The components of the slide assembly include but are not limited to: the slide, the barrel [1,] the trunnion [21,] the firing pin and its spring, the extractor subassembly and the recoil spring subassembly [20.] The slide [5] in this embodiment is part of a composite assembly which includes a rear component which is a slide cover [6] pinned to the slide. This subassembly moves as an integral unit coupled to the frame for longitudinal movement by interior longitudinal grooves [27] of the slide engaging with longitudinal splines [28] on the frame [4.] The trunnion is connected to the frame by laterally projecting longitudinal splines [25] being received within interior longitudinal grooves [26] on the frame. The slide has a forward end face defining a first aperture [18] for the barrel and a pair of second apertures [19] configured to receive guide rods of the recoil spring subassembly. The trunnion includes a zigzag through aperture [24] that defines a cam path surface and the barrel [1] has a follower element [12] that operably engages with the cam surface to rotate the barrel in response to axial movement of the barrel. Although the slide assembly is shown rotated away from the frame, it is actually removable primarily in a longitudinal direction. Removal of the slide from the frame takes the trunnion away with it because the downwardly projecting follower element of the barrel remains trapped within the zigzag slot of the trunnion.

Figure 10B:
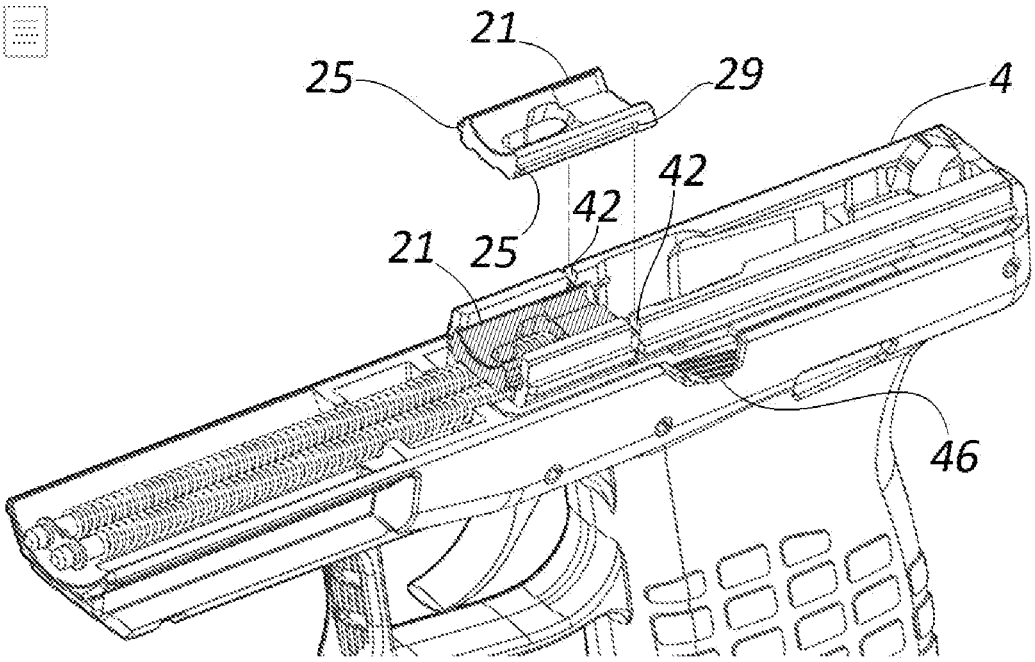
FIG. 10*b* shows an oblique, front left top view of the semiautomatic handgun of FIG. 1*a* with the slide assembly removed to expose the receiver, trunnion, and recoil spring subassembly, and with an additional instance of the trunnion positioned vertically above the original for inspection.

FIG. 10*b* shows an oblique, front left top view of the semiautomatic handgun of FIG. 1*a* with the slide assembly removed to expose the receiver, trunnion, and recoil spring subassembly, and with an additional instance of the trunnion [21] positioned vertically above the original for inspection. The slide is removable along a longitudinal direction when the slide stop [46] is pivoted so that a tab at its forward end opposite the pivot axis of the slide stop is depressed beneath a blocking feature of the slide. Removal of the slide assembly takes the trunnion off along with it. The trunnion includes laterally outwardly projecting splines or ridges [25] which are received within interior longitudinal grooves [26] on the frame [4.]

The firearm trunnion defines an alignment feature that enables firearm to operate when the trunnion is in an operationally correct position and disables firearm operation when the trunnion is in an operationally incorrect position. The trunnion instance which is shaded in this figure shows the operationally correct position. A barrel lock component described in detail below includes a yoke portion having two arms whose tips [42] project upward and are received into a pair of slots or undercuts [29] in the trunnion when the barrel lock is in an elevated position as shown. The barrel lock includes cutouts whereby other trigger mechanism components pass within the cutouts when the barrel lock resides in this elevated position. The barrel lock tips also lock the trunnion from longitudinal motion, so that while elevated as shown, the slide assembly and barrel also may not be removed from the frame. The slots in the trunnion are longitudinally narrow and closely related to the material thickness of the tips of the barrel lock, so that while the tips are elevated and received within the trunnion slots, the trunnion is longitudinally immobilized.

When the barrel lock descends out of its elevated position, its tips clear the trunnion for longitudinal motion, but the cutouts in the barrel lock are displaced out of alignment with the swept volume of the other trigger components, so that trigger motion into a firing position (wherein the sear releases the hammer to strike the firing pin) or a sear reset position (wherein the hammer is re-cocked but locked by the sear until the trigger is at least partially released from the fire position) are both blocked. These operational positions of the trigger are only mechanically available when the barrel lock resides in the elevated position shown, which cannot occur if the trunnion is present and in any other longitudinal position on the frame other than the correct position shown by the shaded instance of the trunnion in this figure.

Figure 11A:
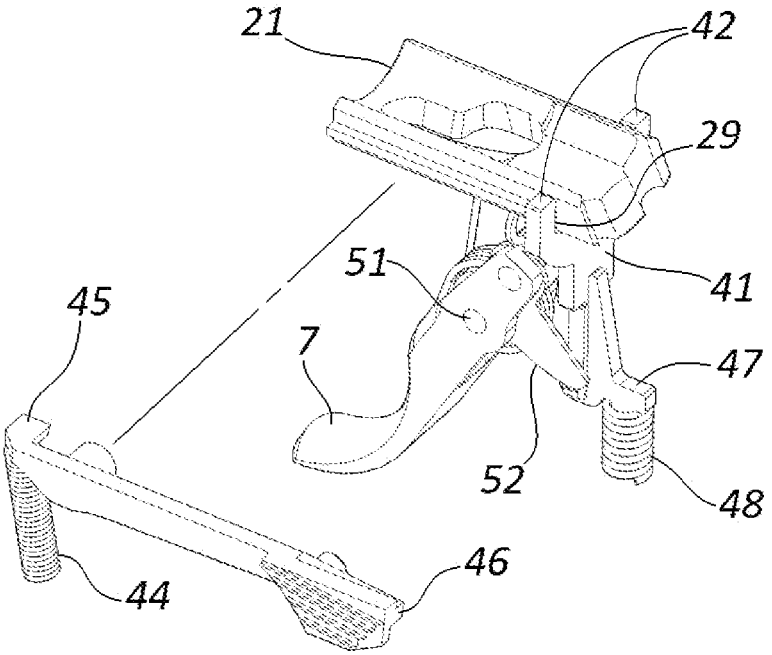
FIG. 11*a* shows an oblique, rear top left view of the slide stop and its spring, and of a subassembly whereby the trigger in its operable positions locks the trunnion from longitudinal travel.

FIG. 11*a* shows an oblique, rear top left view of the slide stop and its spring, and of a subassembly whereby the trigger in its operable positions locks the trunnion from longitudinal travel. The firearm trunnion [21] defines an alignment feature, and the firearm includes a trigger assembly including a keying element operably engaged to the trunnion alignment feature, and operable to enable firearm operation by engaging the alignment feature when the trunnion is in an operationally correct position, and to disable firearm operation when the trunnion is in an operationally incorrect position. The alignment feature of the trunnion may include an undercut or at least one slot [29] in the trunnion. The keying element in this embodiment is either or both of the yoke tips [42] of a barrel lock [41] being received into the trunnion slots. The barrel lock is biased from below for upward movement by a barrel lock plunger [47] coupled to it and transferring upward force from a compressed elastic member [48] which in this embodiment is a helical spring.

The trigger mechanism includes a trigger [7] pivotable about a pin [51] or axle, and a barrel lock cam [52] having a nose projecting into a cutout [43] of the barrel lock. Normal excursions of the nose remain within this cutout while the trigger rotationally operates within a range between released, firing, and sear reset positions.

When it is desired to separate the slide assembly from the frame, the barrel lock is lowered into a release position with its yoke arms dropped out of the trunnion slots. This is accomplished by pushing the trigger from behind. The trigger assembly preferably includes two barrel lock cams which laterally bestride the barrel lock. Each cam has a rearwardly extending nose or lobe with a first upward facing and a second downward facing cam surface. When pivoted forward, the cam lobes descend so that their undersides grab the catch surfaces of the barrel lock and drive the barrel lock downward. When the trigger is pivoted forward enough for the barrel lock yoke arms to drop clear of the trunnion, the barrel lock is said to be in its release position and the slide assembly, which includes the barrel and the trunnion, may be slid along the sliding surfaces of the frame and removed from the weapon. The compression spring beneath the barrel lock is further compressed while the trigger holds the barrel lock yoke arms down to clear the trunnion slots.

When it is desired to re-assemble the slide assembly onto the frame, the barrel and trunnion are first be properly installed and aligned with their receiving features internal to the slide, and with the front ends of the sliding surfaces of the frame engaged with the rear ends of the sliding surfaces of the slide. The user then pivots the trigger forward to lower the barrel lock into its release position with its yoke tips residing lower within the frame than the underside surface of the trunnion. If the slide assembly is slid to a location other than one in which the trunnion slots are aligned with the yoke tips, the yoke cannot rise out of its release position.

When the trunnion slots are aligned with the yoke arms, the compression spring raises the barrel lock yoke arms rise to seat within the slots in a locked position wherein the trunnion is restrained from any forward or rearward translation beyond the manufacturing clearances of the longitudinal length of the slots and the thickness of the yoke arm tips received in the slots. The user will hear and feel a "click-in" of the yoke tips upon proper assembly without needing to see the components coming into alignment. Since the barrel follower is trapped for excursion only within the extents of the trunnion slot, the slide assembly while intermated with the sliding surfaces of the frame cannot be slid clear of the frame and will remain coupled to it.

Lastly in this figure, the slide stop [46] is shown exploded away from the trigger subassembly and trunnion along its pivot axis. A forward tab [45] on the slide stop depresses as the slide assembly is longitudinally slid into its operational position. The slide stop catches the slide assembly and holds it in a retracted position after the last round is fired out of the weapon or when the user wishes to lock the slide back for inspection of the barrel chamber and magazine well, or for reloading or topping off the number of rounds stored in the magazine. The slide excursion during recoil aligns a tab receiving feature with the tab on the slide stop and the slide stop spring [44] then raises the tab into its complementary cavity in the slide, holding the weapon open.

Figure 11B:
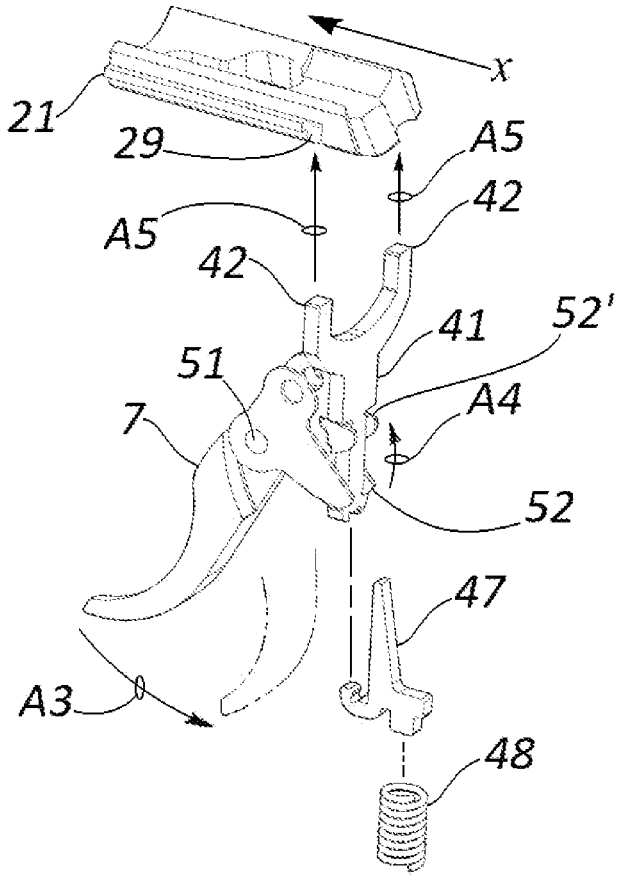
FIG. 11*b* shows an exploded view of the trigger, the trunnion, and a subassembly of trunnion locking and unlocking components whereby the in its operable positions lock the trunnion from longitudinal travel but whereby the trigger in an inoperable position allows longitudinal travel of the trunnion and disassembly of the slide assembly from the frame and receiver of the firearm.

FIG. 11*b* shows an exploded view of the trigger, the trunnion, and a subassembly of trunnion locking and unlocking components whereby the trigger in its operable positions lock the trunnion from longitudinal travel but whereby the trigger in an inoperable position allows longitudinal travel of the trunnion and disassembly of the slide assembly from the frame and receiver of the firearm.

The trunnion [21] includes outward facing vertical slots [29] into which are received the tips of two arms [42] of a barrel lock [41] which is a Y-shaped yoke having a blade portion extending vertically downward towards the trigger mechanism. The barrel lock has a step change in width from a first width by the yoke to a second narrower width, leaving two coplanar downward facing shoulder surfaces. The bottom of the barrel lock includes two tabs which extend laterally to a width similar to the first width. The tabs include upward facing catch surfaces. The barrel lock is biased for upward motion by an elastic member [48] in contact with it. In the embodiment shown, the elastic member is a helical spring in compression delivering an upward force at the base of the barrel lock. The upward force enters the barrel through the bottom end of a tapered rib of a barrel lock plunger [47] perpendicular to the blade portion of the barrel lock.

While the yoke resides in its release position, the downward facing shoulder surfaces of its blade portion prevent the trigger from being pivoted out of its forward position by blocking the upper surfaces of the trigger lobes from rising. While the yoke tips remain suppressed beneath the underside of the trunnion, the trigger cannot be pulled and the sear and other components of the fire control group cannot be operated. When the slide assembly is axially positioned so that the trunnion slots align with the blade portion of the yoke so that the yoke arm tips may rise along arrows [A5] and seat within the slots, the shoulder surfaces of the blade portion of the yoke also rise enough so that they no longer interfere with the trigger cams during pivot motions of a trigger pull. This correctly assembled configuration allows the trigger [7] to pivot along arc arrow [A3] and about pin [51] from its conspicuously forward position into a released but ready to fire position. During this travel, the noses of the barrel lock cams swing along arc arrow [A4,] and if the barrel lock is in its elevated position then during normal operations of the trigger, the trigger cam noses move within the cutouts of the barrel lock between the ready or reset position at [52] and the firing position at [52'.]

Thus, this portion of the invention prevents attempts to fire the weapon while the slide assembly is close to but not properly longitudinally aligned and locked to the frame. If the slide assembly were to be slid rearwardly past its proper alignment with the frame, a portion of its internal components or features would collide with a feature or component of the frame or the hammer which would arrest further rearward motion as long as the barrel lock yoke tips remain trapped beneath a forward portion of the trunnion. In this condition the trigger would also be forced to remain in a conspicuously forward position preventing or impeding a trigger finger from entering within the trigger guard forward of the trigger.

In another case where the slide assembly is too far forward, sliding the slide assembly rearward without pivoting the trigger forward to drop the barrel lock would allow the rear surface of the trunnion to collide with the raised yoke tips of the barrel lock, arresting further rearward motion and leaving the slide assembly too far forward for the hammer to strike the firing pin even if the barrel were assembled into the upper with a cartridge in the chamber. This misaligned condition is also visually conspicuous, and the other underside portions of the slide interfere with and prevent ammunition rising up out of the ammunition well and into alignment of the chamber of the barrel as well. Thus, both of these conspicuous misalignments deny operation of the fire control system and serve to alert the user that the weapon is not properly assembled and is not in condition to fire, and would more often than not also serve to protect a live round in the chamber from accidental discharge even if the weapon is dropped in a misaligned condition.

Figure 12:
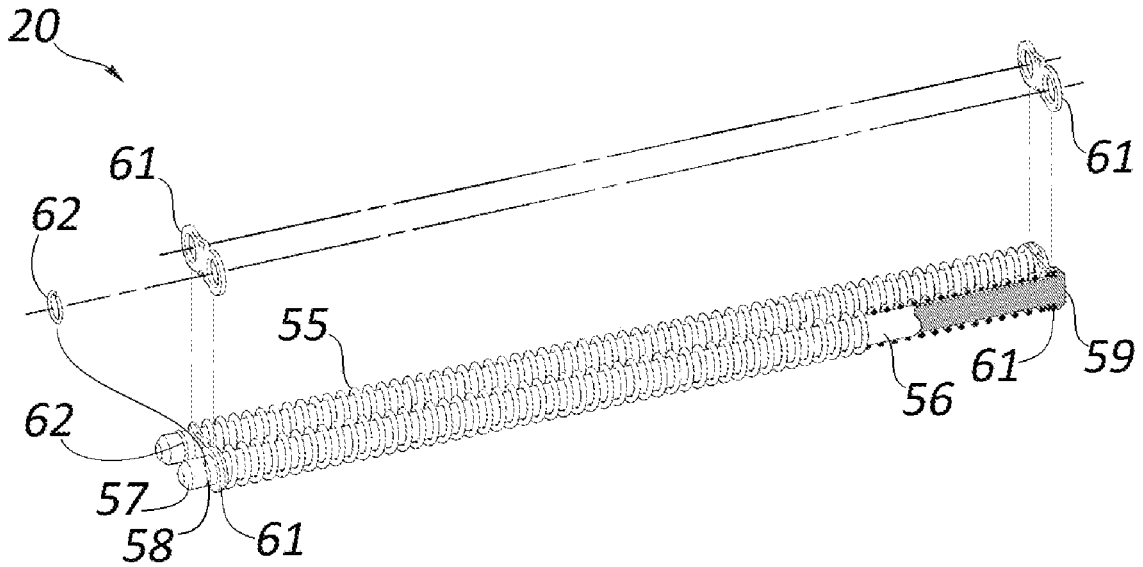
FIG. 12 shows an oblique, front top left view of an embodiment of a recoil spring assembly for a semiautomatic handgun in accordance with the invention.

FIG. 12 shows an oblique, front top left view of an embodiment of a recoil spring assembly [20] for a semiautomatic handgun in accordance with the invention. The recoil spring assembly interfaces with the slide and the frame, the recoil spring assembly includes a pair of adjacent guide rods [56,] with each guide rod encompassed by a helical spring [55.] The guide rods are connected to each other at their respective ends by capture elements [61,] with the springs being captured by the capture elements. The capture elements of the embodiment shown are perforated tie bars. The guide rods pass through the apertures in the tie bars. Each guide rod has a first end with an enlarged flange or head [59] larger than the apertures of the first of the two tie bars, and a second end with a chamfer [57] or fillet to assist with assembly of threading components onto them. The second ends of the guide rods include snap ring grooves [58] which receive snap rings [62] that trap the second tie bar with the springs residing between the tie bars.

The first end of the recoil spring assembly seats into the frame of the weapon and the tips of the second ends of the guide rods pass through apertures in the front face of the slide. An interior bulkhead surface of the front face of the slide contacts the tie bar at the second end of the assembly so that during recoil the set of springs are compressed in concert and the second ends of the guide rods protrude through the front face of the slide.

Figure 13A:
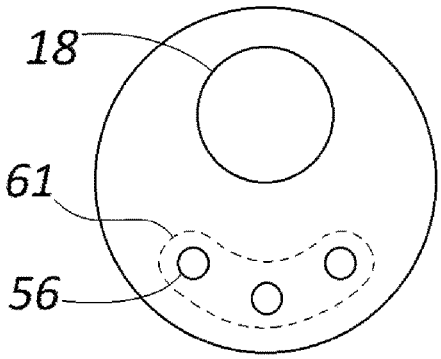
FIG. 13*a* shows a stylized front view of a slide assembly of a semiautomatic handgun having an alternative embodiment of a recoil spring subassembly in accordance with the invention.

FIG. 13*a* shows a stylized front view of a slide assembly of a semiautomatic handgun having an alternative embodiment of a recoil spring subassembly in accordance with the invention. The slide has a forward end face defining a first aperture [18] for the barrel, and a pair of second apertures configured to receive the guide rods [56.] In this embodiment the set of recoil springs and their guide rods are arranged in an arcuate array in an operating space within the slide and frame and below the barrel. The tie bars [61] are arcuate strips having a plurality of apertures for the guide rods which pass through them. In preferable embodiments the entire forward facing surface of the forward tie bar contacts an interior bulkhead surface of the front face of the slide, so that during recoil the entire set of recoil springs may act in concert.

Figure 13B:
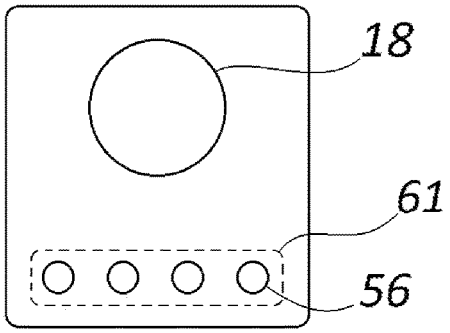
FIG. 13*b* shows a stylized front view of a slide assembly of a semiautomatic handgun having another alternative embodiment of a recoil spring subassembly in accordance with the invention.

FIG. 13*b* shows a stylized front view of a slide assembly of a semiautomatic handgun having another alternative embodiment of a recoil spring subassembly in accordance with the invention. The slide has a forward end face defining a first aperture [18] for the barrel and a pair of second apertures configured to receive the guide rods [56.] In this embodiment the set of recoil springs and their guide rods are arranged in a linear array in an operating space within the slide and frame and below the barrel. The tie bars [61] are linear strips having a plurality of apertures for the guide rods which pass through them. According to alternative embodiments, one or more springs among the plurality of springs within a recoil spring assembly may have various spring rates as determined by spring wire diameter, helical pitch, materials, material tempers and other variables, and one or more springs may be shorter than others so that only a subset of the springs remain compressed and in contact with the forward tie bar while the slide is fully forward. The shorter springs take up compression at later portions of the recoil and provide a non-linear spring constant for the spring-mass system of the slide operating on the frame.

Figure 14A:
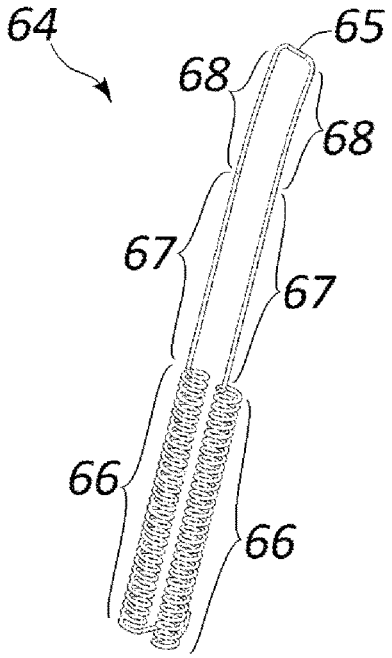
FIG. 14*a* shows an oblique, front top left view of a hammer spring for a semiautomatic handgun in accordance with the invention.
Figure 14B:
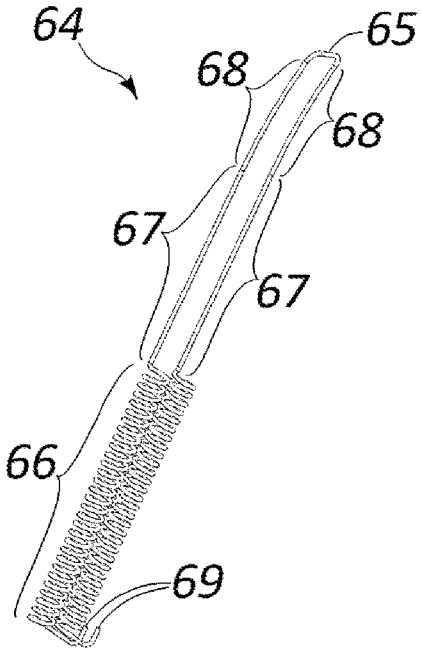
FIG. 14*b* shows an oblique, rear left bottom view of the hammer spring of FIG. 14*a*.

FIG. 14*a* shows an oblique, front top left view of a hammer spring for a semiautomatic handgun in accordance with the invention. FIG. 14*b* shows an oblique, rear left bottom view of the hammer spring of FIG. 14*a*. In the following paragraphs, the features referenced and visible in both FIGS. 14*a* and 14*b* shall be described simultaneously. The inventive hammer spring [64] includes a bail-shaped tongue portion comprising two spaced apart and substantially parallel rods or beams connected at their upper ends by a lintel or bail portion [65.] Each beam includes a substantially straight portion [67] and a slightly arcuate portion [68] proximate to the lintel portion. The lower ends of the rods of the bail are each formed into a helical tension spring [66] terminating with a tangent leg extension [69 of FIG. 14*b*] which further curls or includes an additional bend to form a hook or catch at its tip.

The entire hammer spring may be formed out of a continuous length of wire, and in a preferable embodiment the two helical portions are wound counter to each other; i.e, one helical portion comprises a left-hand helix and the other helical portion comprises a right-hand helix. The construction, location, and operation of the inventive hammer spring solves long-known problems with where to locate the bulk volume of a firearm hammer spring and overcomes the Hooke's Law decrease in spring tension as a tensile spring returns from an extended to a relaxed length.

Figures 15A, 15B, 15C:
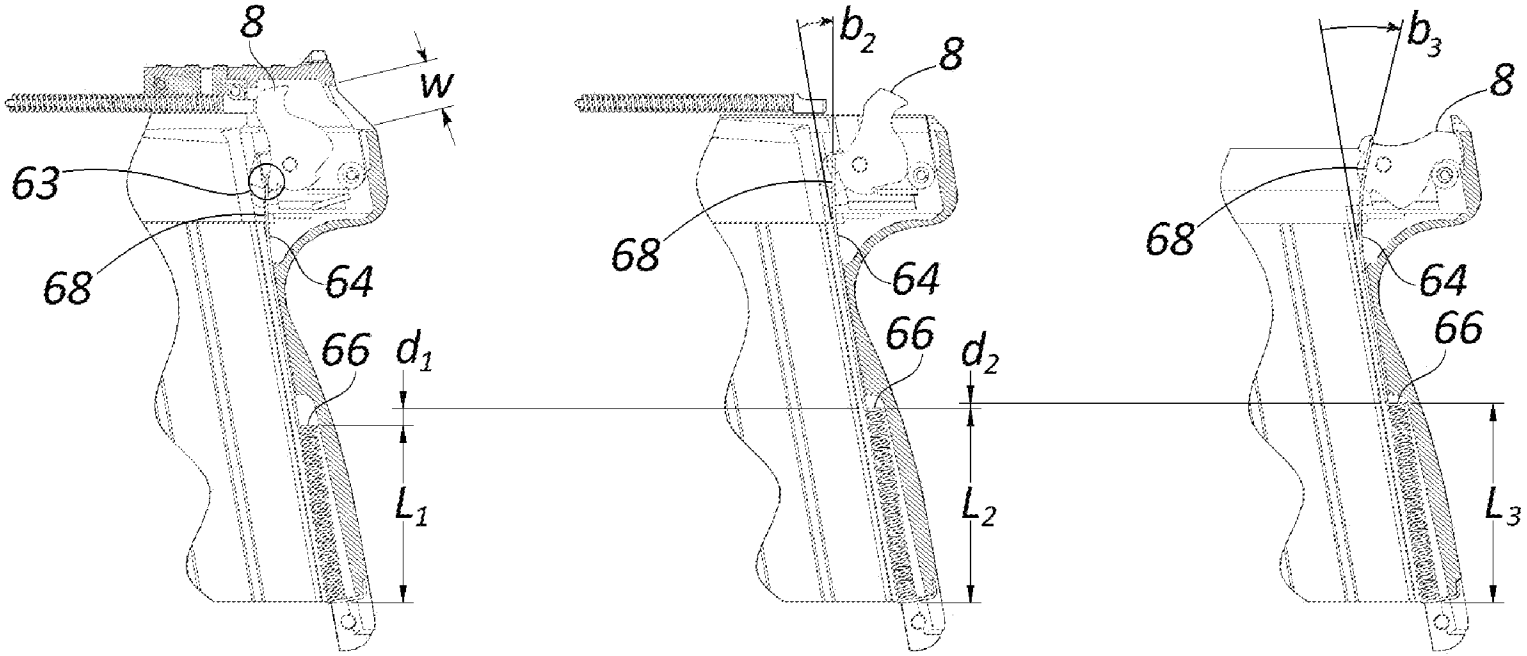
FIG. 15*a* shows a partial cross section view of a rear portion of the grip of a semiautomatic handgun in accordance with the invention taken at section A-A of FIG. 1*b* with the hammer in a de-cocked position.
FIG. 15*b* shows a partial cross section view of the rear portion of the grip shown in FIG. 15*a* with the hammer in a partially cocked position.
FIG. 15*c* shows a partial cross section view of the rear portion of the grip shown in FIG. 15*a* with the hammer in a fully cocked position.

FIG. 15*a* shows a partial cross section view of a rear portion of the grip of a semiautomatic handgun in accordance with the invention taken at section A-A of FIG. 1*b* with the hammer in a de-cocked position. FIG. 15*b* shows a partial cross section view of the rear portion of the grip shown in FIG. 15*a* with the hammer in a partially cocked position. FIG. 15*c* shows a partial cross section view of the rear portion of the grip shown in FIG. 15*a* with the hammer in a fully cocked position.

In the following paragraphs, the features referenced and visible in FIGS. 15*a*, 15*b*, and 15*c* shall be described simultaneously. The hammer [8] is pivotally connected to the frame and the hammer spring is connected to the frame and to the hammer. In FIG. 15*a*, the slide cover or aft portion of the slide includes a window [w] allowing a user to see the cocked, half-cocked, or uncocked state of the hammer. The hammer spring has a first helical tension element [66] configured to bias the hammer by elongation and a second linear portion [68] configured to bias the hammer by lateral or cantilever flexure.

The hammer includes a transverse slot [63] into which the lintel portion is seated. When the hammer is cocked from a first, decocked position (FIG. 15*a*) in addition to first extending the tandem coils of the spring at a second, intermediate position (FIG. 15*b*) the non-coiled legs of the bail or tongue portion [68] are drawn over a fulcrum portion [64] of the frame while the coils, both tightly residing in an adjacent pair of silos in the grip, are substantially prevented from bending out of their extension axes. At and beyond this second point in the cocking motion the bail portion of the spring is brought into cantilever bending. Thus during the first portion of the cocking motion, the first, axial reaction force of the extension spring applies a first reaction torque to the hammer, but the moment arm length of the first force decreases as the spring receiving slot of the hammer rotates about the hammer pivot point, reducing the magnitude of the restoring torque. As the benefit of the first force wanes, the reaction force of the cantilever bending comes to bear and increases with the continued rotation of the hammer past the second position. When the hammer is released from a full cock position (FIG. 15*c*) by the fire control components, the cantilever forces stored in the bent bail portion are the first to accelerate the hammer into forward rotation, and then in concert with this force dissipating as the bail returns to an unloaded planar shape, the twin tensile forces of the helical portions of the spring apply increasing accelerating torque as the slot continues to rotate and the moment arm the slot continues to increase sinusoidally.

During cocking of the hammer from an un-cocked position (FIG. 15*a*) to half-cock position (FIG. 15*b*) the rotation of the hammer slot that pulls the hammer spring bail upward, extending the helical coil portions of the hammer spring from an exemplary length [$L_1$] to [$L_2$,] or a distance [$d_1$.] During this rotation of the hammer, the bail portion of the hammer spring bends to an angle [$b_2$.] The length of the lever arm perpendicular to the extension direction of the helical portion of the hammer spring remains substantial, so the tensile forces of the hammer spring coils remain the primary reaction force providing torque to the hammer.

Cocking the hammer further from half-cock to fill cock position (FIG. 15*c*) the hammer rotates by roughly the same angle as from un-cocked to half-cock, but the additional extension of the helical coil portions of the hammer spring extend from length [$L_2$] to [$L_3$,] or a distance [$d_2$] which is much less than [$d_1$.] The lever arm for the applied force decreases substantially, so the angular acceleration from this portion of the restoring force of the spring would be sluggish. To compensate for this, during this phase of the cocking cycle the inventive spring design now accumulates substantial cantilever bending force in its upper portion seen by the increased bending of that portion from angle [$b_2$] to [$b_3$.] The lever arm of this cantilever force is oriented in a forward direction and remains of substantial length when firing and the free hammer rotates forward. In motion, just as the cantilever force wears off halfway into the fall of the hammer, the downward pull of the spring coils takes over so that substantial accelerative torque is applied to the hammer throughout its entire striking motion.

Additionally, the inventive hammer spring locates much of its operating volume in a portion of the grip unused by other mechanisms and rarely used effectively for other mechanisms or features of a modem handgun, and compared to the multiple coils of a conventional torsional spring, the bail portion of the hammer spring in the vicinity of the hammer is especially and advantageously compact, allowing for a thinner overall design which offers corollary benefits in reduced bulk, weight, holster size, and concealability or not creating a "print" when worn underneath outer clothing, and a weapon of effective caliber becomes more suitable, comfortable, and controllable for people with smaller hands.

FIG. 16*a* shows an oblique, rear top left view of a grip bottom or magazine well bottom cap [30] for a semiautomatic handgun in accordance with the invention. In this portion of the specification describing the handgun grip portion, internal components in the grip such as the ammunition follower and the feed spring operating between the bottom cap, and the follower, the words "axis" and "axial" shall mean a direction parallel to the central axis of the ammunition well inside the grip and the feed direction of the follower while cartridges are being removed or expended from the ammunition well. "Longitudinal" in this portion of the specification shall mean a direction parallel to the axis of the barrel and the shooting direction of the weapon, as opposed to along the axis defined by the magazine well. Thus in this portion of the specification, the axial direction defined by the ammunition well is not necessarily perpendicular to the longitudinal direction of the barrel and the slidable direction for the slide assembly components.

The bottom cap also includes at its forward portion a tongue [32] extending upward and a pair of arms or tabs [34] at the top of the tongue that extend rearward and longitudinally. The top of the tongue includes a central notch [33] which registers with a complementary guide feature at the midplane of the forward portion of the bottom of the grip body. The bottom portion of the grip includes grooves or slots complementary to the tabs of the cap, so that when the cap is slidingly coupled to the underside of the grip and its downwardly open magazine well cavity, i.e, slid rearward in a longitudinal direction substantially parallel to shooting direction and barrel axis, the tabs are received into the grooves or slots in the grip and the cap is secured to the bottom of the grip. The bottom cap includes an axially upward facing cavity [35] and a rim and in preferable embodiments the cap is secured by a pin passing through a transverse aperture [37.] The bottom cap includes inward facing ribs [36] spaced apart to accommodate the diameter of the ammunition cartridge for which the handgun is designed to shoot. The bottom cap also includes one, more, or preferably two axially oriented apertures [38] which receive prongs of the magazine follower when it is lowered enough within the magazine well for them to appear therein.

FIG. 16*b* shows an oblique, front bottom left view of a grip bottom or magazine well bottom cap [30] for a semiautomatic handgun in accordance with the invention. In the type of embodiment shown, the component may be insert molded and as a molded part may have a parting line in a sagittal plane with generous draft angles which conform to the bottom of the grip into a comfortable base like the pommel of a blade weapon. The keel formed at the parting line may act advantageously as a tactile aid by communicating a sensation of the barrel direction to the palm of a shooter's support hand cupping the grip by its base.

The upwardly extending tongue [32] includes a central notch [33] at the top of the tongue which registers with a complementary guide feature at the midplane of the forward portion of the bottom of the grip body. A forward facing midplane groove on the exterior of the tongue may also provide positive grip and provide tactile aid by communicating a sensation of the barrel direction to the fingers of the shooter's hand gripping its base. The bottom cap may be secured by a pin passing through a transverse aperture [37] in the rear of its base. Near the lower rear are two apertures [38] which receive prongs of the magazine follower when it is lowered enough within the magazine well for them to appear. The upwardly extending tongue includes a pair of arms or tabs [34] at its top that extend rearward and longitudinally.

FIG. 16*c* shows a cross section view of the grip bottom [30] of FIG. 16*a* taken at the offset section line B-B of FIG. 4, and in which the cross hatching of the section is applied to the void space defining the magazine well. The cross section of the perimeter of the cavity in the base is congruent to a perimeter of the cross section of the ammunition well cavity taken at a plane within the grip body and parallel to the comparative cross section plane taken within the bottom cap, and in preferable embodiments the number and alignments of internally facing ribs [36] in the bottom cap cavity are the same as those within the ammunition well of the grip, and the minimum internal width dimension [e] for ribs within the grip is the same as for the ribs within the bottom cap cavity.

FIG. 16*d* shows a cross section view of the lower portion of the grip [3*b*] and bottom cap [30] of the semiautomatic handgun of FIG. 1*a* taken at section line C-C of FIG. 4. In preferable embodiments the width [e] is minimally greater than the diameter of an ammunition cartridge so that the stored rounds stack up in a single plane which is preferably the sagittal plane. Although as seen in this figure the internal, inward facing ribs [36'] of the magazine well in the grip body are congruent to, aligned with, and equal in number to the inward facing ribs [36] of the bottom cap, it is within the scope of the invention but less preferred to have internal ribs disjoint from or otherwise at variance in number, longitudinal direction of extension, or cross section as compared to those of the magazine well in the grip body.

FIG. 17 shows the cut section of the lower portion of the grip [3*b*] and the bottom cap [30] of the semiautomatic handgun of FIG. 16*d* rotated to an oblique, rear top right view. The bottom cap is secured to the grip body by a transverse pin [9] passing through both components and held in place by an interference fit. The longitudinal tabs [34] extending from the tongue [32] of the bottom cap are closely fitted to and interdigitate with complementary tab receiving features in the grip body that also support the tongue and bottom cap by its tabs. In preferable embodiments the ribs within the cavity of the bottom cap are equal in number, aligned with, coaxial to, and are in effect extensions or continuations of the ribs in the ammunition well.

When manufactured in plastic by traditional injection molding, die casting, or metal injection molding (MIM) the mold tool may be designed with a central core being a long, constant cross-section bar including longitudinal grooves which define the inward-facing ribs [36] lining the cavity which are preferably aligned extensions of the ribs [36']

within the ammunition well of the grip body. Flexible mold tooling would allow both the grip to be manufactured to various optional lengths and the cap to be manufactured to various depths so that a selection of effective magazine capacities would be available for each particular make or model in production and for the cartridge caliber to which they are designed to handle.

Figure 18:
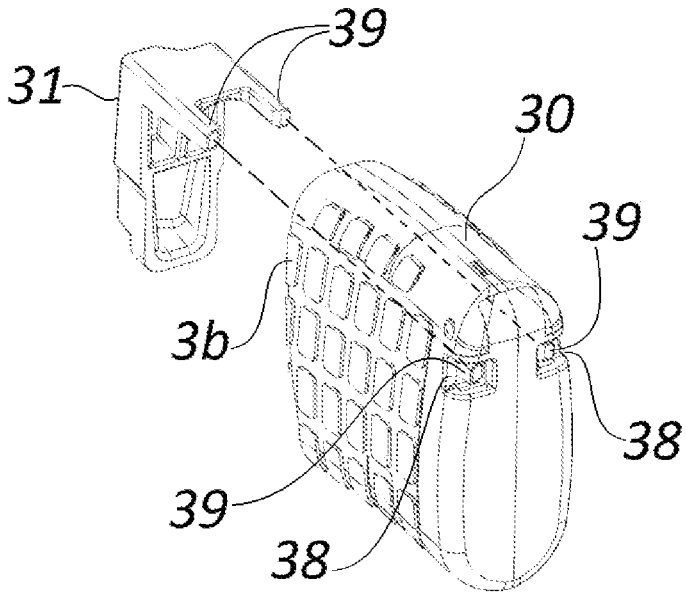
FIG. 18 shoes an oblique, rear bottom left view of the cut section of the lower portion of the grip and the bottom cap of the semiautomatic handgun of FIG. 16*d* with the magazine follower showing a fully loaded condition, and a second instance of the magazine follower displaced upwardly in the feed direction and emerged from the lower portion of the grip.

FIG. 18 shoes an oblique, rear bottom left view of the cut section of the lower portion of the grip [3*b*] and the bottom cap [30] of the semiautomatic handgun of FIG. 16*d* with the magazine follower showing a fully loaded condition, and a second instance of the magazine follower [31] displaced upwardly in the feed direction and emerged from the lower portion of the grip. The ammunition follower includes at least one but preferably a pair of downwardly projecting prongs [39] which extend substantially parallel to the axis of the ammunition well. The bottom cap includes complementary cutouts [38] extending axially through the floor of its cavity.

The prong lengths are determined so that when the magazine is at full capacity the prong tips are visible in the bottom cap cutouts. In preferable embodiments the axial length of the visible portion of the prong tips is less than the diameter of an ammunition round so that if the magazine contains even one round less than its full capacity, the follower spring pushes the follower up within the magazine well to a position wherein the prongs are entirely retracted into the magazine well and are not readily visible to the shooter. In some preferable embodiments the material of the follower is a brightly colored material so that the visible prong tips contrast starkly against the darker or drab exterior color of the grip body.

Figure 19:
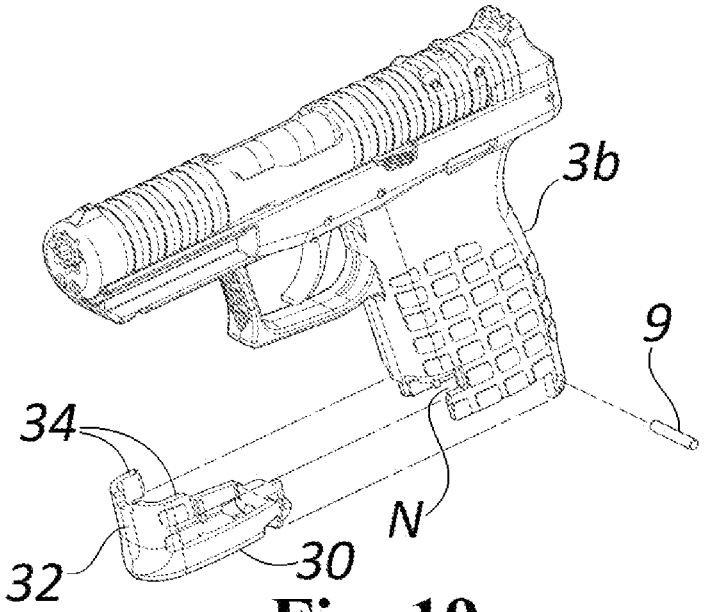
FIG. 19 shows an oblique, front top left view of the semiautomatic handgun of FIG. 1*a* with the bottom cap restraining pin removed and the bottom cap slid forward and clear of the bottom of the grip.

FIG. 19 shows an oblique, front top left view of the semiautomatic handgun of FIG. 1*a* with the bottom cap restraining pin [9] removed and the bottom cap [30] slid forward and clear of the bottom of the grip. The bottom cap also includes at its forward portion a tongue [32] extending upward and a pair of arms or tabs [34] at or near the top of the tongue that extend rearward. The bottom portion of the grip includes grooves or slots [N] complementary to the tabs so that when the cap is slidingly coupled to the underside of the grip and its downwardly open magazine well cavity, the cap may be slid rearward into an installed position wherein its tabs are received into the grooves or slots in the grip.

According to some variants within the scope of the invention, the tabs tips or mutually inward facing surfaces may include latching features so that in cooperation with complementary transverse recesses in the grooves or slots of the grip, a latching, snap-in, tactile detent, or a click is experienced to inform the user that the cap is fully seated and installed completely or otherwise secured to the grip. The tab and groove interface provides vertical support to the bottom cap and keeps it secured to the grip body. Once installed, a transverse pin or threaded hardware transfixes the bottom cap to the grip.

FIG. 20 shows a cross section view of the lower portion of the grip [3*b*] and the bottom cap [30] of the semiautomatic handgun of FIG. 1*a* taken at section line E-E of FIG. 4, and also showing the bottom cap as broken portions to illustrate an alternative embodiment for extending the ammunition capacity of the magazine well. When loaded to its full capacity of ammunition, the follower spring is compressed to a compressed height.

According to another alternative within the scope of the invention, the bottom cap may be manufactured as an extension tube wherein the cavity is deep enough within the tube to accept a substantial portion or all of the follower [31] and the follower spring in its compressed state, or both. Compared with embodiments of the bottom cap previously described, these alternative embodiments act as a magazine extension substantially increasing the ammunition capacity of the weapon.

As mentioned for FIG. 17, when manufactured in plastic by traditional injection molding, die casting or metal injection molding (MIM) the mold tool may be designed with a central core being a long, constant cross-section bar including longitudinal grooves which define the inward-facing ribs lining the cavity which are preferably aligned extensions of the ribs within the ammunition well of the grip body. The mold tool may be designed with exterior sleeves of various lengths and receiving appropriate partial lengths of the central core bar, to enable flexible production of bottom cap extension tubes of a number of different lengths to offer several different quantities of additional ammunition capacity.

Many modifications and variations may be made to the invention as disclosed herein without departing from its spirit and scope. Thus, although many exemplary embodiments are described above, it will be appreciated that the invention is intended to cover all modifications and equivalents within the scope of the following claims.

I claim:

1. A firearm comprising:

a frame;

a slide connected to the frame and operable to reciprocate between a forward battery position and a rearward recoil position;

a barrel connected to the frame and to the slide;

the barrel with a forward muzzle end and a rearward chamber end operable to rotate between a locked position and an unlocked position;

the barrel having a locking element proximate the forward end;

the locking element configured to interface with the slide in the locked position when the slide is in the battery position to prevent axial movement of the slide with respect to the barrel;

the locking element configured to enable relative movement of the slide with respect to the barrel when the barrel is in the unlocked position;

including a trunnion connected to the frame and defining a cam path surface, the barrel having a follower element operably engaged to rotate the barrel in response to an axial movement of the barrel; and wherein the trunnion defines an alignment feature, and the firearm includes a trigger assembly including a key element operably engaged to the trunnion alignment feature, and operable to enable firearm operation by engaging the alignment feature when the trunnion is in an operationally correct position, and to disable firearm operation when the trunnion is in an operationally incorrect position.

2. The firearm of claim 1, wherein the locking element includes a plurality of protruding lugs.

3. The firearm of claim 2, wherein the plurality includes at least 8 lugs.

4. The firearm of claim 1, wherein the slide defines a locking feature configured to receive the locking element.

5. The firearm of claim 1, wherein the locking feature defines a plurality of forwardly open lugways.

6. The firearm of claim 5, wherein the slide has a forward portion defining a barrel aperture and the lugways surround the aperture.

7. A firearm comprising:

a frame;

a slide connected to the frame and operable to reciprocate between a forward battery position and a rearward recoil position;

a barrel connected to the frame and to the slide;

the barrel with a forward nuzzle end and a rearward chamber end operable to rotate between the locked position and an unlocked position;

the barrel having a locking element proximate the forward end;

the locking element configured to interface with the slide in the locked position when the slide is in the battery position to present axial movement of the slide with respect to the barrel;

the locking element configured to enable relative movement of the slide with respect to the barrel when the barrel is in the unlocked position; and including a hammer pivotally connected to the frame and a hammer spring connected to the frame and to the hammer, the hammer spring having a first helical tension element configured to bias the hammer by elongation and a second linear portion configured to bias the hammer by cantilever flexure.

8. A firearm comprising:

a frame;

a slide connected to the frame and operable to reciprocate between a forward battery position and a rearward recoil position;

a barrel connected to the frame and to the slide;

the barrel with a forward muzzle end and a rearward chamber end operable to rotate between a locked position and an unlocked position;

the barrel having a locking element proximate the forward end;

the locking element configured to interface with the slide in the locked position when the slide is in the batter position to prevent axial movement of the slide with respect to the barrel;

the locking element configured to enable relative movement of the slide with respect to the barrel when the barrel is in the unlocked position; and including a recoil spring assembly interfacing the slide and the frame, the recoil spring assembly including a pair of adjacent guide rods, each guide rod encompassed by a helical spring, the guide rods connected to each other at respective ends by capture elements, the springs being captured by the capture elements.

9. The firearm of claim 8, wherein the slide has a forward end face defining a first aperture for the barrel, and a pair of second apertures configured to receive the guide rods.

10. The firearm of claim 7, wherein the locking element includes a plurality of protruding lugs.

11. The firearm of claim 10, wherein the plurality includes at least 8 lugs.

12. The firearm of claim 7, wherein the slide defines a locking feature configured to receive the locking element.

13. The firearm of claim 7, wherein the locking feature defines a plurality of forwardly open lugways.

14. The firearm of claim 13, wherein the slide has a forward portion defining a barrel aperture and the lugways surround the aperture.

15. The firearm of claim 8, wherein the locking element includes a plurality of protruding lugs.

16. The firearm of claim 15, wherein the plurality includes at least 8 lugs.

17. The firearm of claim 8, wherein the slide defines a locking feature configured to receive the locking element.

18. The firearm of claim 8, wherein the locking feature defines a plurality of forwardly open lugways.

19. The firearm of claim 18, wherein the slide has a forward portion defining a barrel aperture and the lugways surround the aperture.

* * * * *